US011866945B2

(12) United States Patent
Jasinski

(10) Patent No.: US 11,866,945 B2
(45) Date of Patent: Jan. 9, 2024

(54) METHODS OF CONSTRUCTING FLOATING TILE-BASED FLOORING AND STAIRCASE SYSTEMS AND COMPONENTS THEREOF

(71) Applicant: Dexx IP Holdings, LLC, Norfolk, VA (US)

(72) Inventor: Chris Jasinski, Woodstock (CA)

(73) Assignee: CB Interests Inc., Woodstock (CA)

( * ) Notice: Subject to any disclaimer, the term of this patent is extended or adjusted under 35 U.S.C. 154(b) by 0 days.

(21) Appl. No.: 17/320,062

(22) Filed: May 13, 2021

(65) Prior Publication Data

US 2021/0355690 A1 Nov. 18, 2021

Related U.S. Application Data

(60) Provisional application No. 63/024,131, filed on May 13, 2020.

(51) Int. Cl.
*E04F 15/02* (2006.01)
*E04F 19/04* (2006.01)
*E04F 15/08* (2006.01)

(52) U.S. Cl.
CPC .... *E04F 15/02183* (2013.01); *E04F 19/0459* (2013.01); *E04F 15/08* (2013.01)

(58) Field of Classification Search
CPC ..... E04F 15/02183; E04F 19/0459; E04F 19/0477; E04F 15/08; E04F 2001/405; E04F 11/16; E04F 15/02458; E04F 19/04
See application file for complete search history.

(56) References Cited

U.S. PATENT DOCUMENTS 4,698,249 A * 10/1987 Brown ..... E04F 15/186 428/44
4,942,708 A * 7/1990 Krumholz ..... E04H 3/24 52/126.6
5,060,438 A * 10/1991 O'Rourke ..... E04F 11/16 52/287.1
5,226,273 A 7/1993 Burke
(Continued)

FOREIGN PATENT DOCUMENTS

CA 3095909 A1 * 4/2019 ..... E04F 15/02022
CN 204609156 9/2015
(Continued)

OTHER PUBLICATIONS

International Search Report and Written Opinion dated Jun. 25, 2019 in related International Patent Application No. PCT/CA2019/050406 (11 pages).
(Continued)

*Primary Examiner* — Theodore V Adamos
(74) *Attorney, Agent, or Firm* — Bereskin & Parr LLP

(57) ABSTRACT

Systems and methods of covering structural bases are described herein. The systems include a plurality of floating field tiles arranged to cover a top surface of the structural base, a mat positioned between a bottom surface of at least one of the floating field tiles and a top surface of the structural base and a coping system secured to the top surface of the structural base. The coping system has an upper edge that is level with or below a top surface of the floating field tiles and forms a fixed perimeter around the plurality of floating field tiles to inhibit lateral movement of the plurality of floating field tiles.

19 Claims, 37 Drawing Sheets

(56) References Cited

U.S. PATENT DOCUMENTS

| | | | | |
|---|---|---|---|---|
| 5,280,692 | A | 1/1994 | Patey | |
| 5,479,750 | A | 1/1996 | Carlberg | |
| 5,623,799 | A * | 4/1997 | Kowalski | E04F 15/02022 52/391 |
| 5,806,253 | A * | 9/1998 | Nelson | E04F 11/166 52/718.04 |
| 6,301,842 | B1 | 10/2001 | Chaney et al. | |
| 6,314,652 | B1 | 11/2001 | English | |
| 6,338,229 | B1 * | 1/2002 | Botzen | E04F 19/061 52/287.1 |
| 6,804,923 | B1 * | 10/2004 | Potter | E04B 5/04 52/480 |
| 7,631,463 | B2 | 12/2009 | Greenlee et al. | |
| 7,946,085 | B2 | 5/2011 | Prins | |
| 8,266,849 | B2 | 9/2012 | Bravo et al. | |
| 8,667,744 | B2 | 3/2014 | Shaw | |
| 9,151,063 | B2 | 10/2015 | McManus | |
| 10,941,575 | B2 * | 3/2021 | Raine | E04F 11/166 |
| 2003/0051428 | A1 | 3/2003 | Kay et al. | |
| 2005/0257468 | A1 * | 11/2005 | Serros | E04F 13/142 52/396.1 |
| 2008/0105172 | A1 * | 5/2008 | Repasky | E04F 15/02183 108/150 |
| 2009/0056235 | A1 * | 3/2009 | Morsching | E04F 19/064 52/741.1 |
| 2011/0163510 | A1 * | 7/2011 | Wedi | E04F 19/061 156/60 |
| 2011/0283636 | A1 * | 11/2011 | Vanhastel | E04F 19/02 52/179 |
| 2012/0090256 | A1 * | 4/2012 | Andrews | E04F 15/02044 52/263 |
| 2014/0174005 | A1 * | 6/2014 | Richard | E04F 11/175 52/741.2 |
| 2017/0152635 | A1 * | 6/2017 | Tabibnia | E04F 15/02482 |
| 2018/0038117 | A1 * | 2/2018 | Bordin | E04F 15/02458 |
| 2018/0051893 | A1 * | 2/2018 | Bordin | E04B 5/48 |
| 2020/0199889 | A1 * | 6/2020 | Neustaeter | E04F 15/02183 |

FOREIGN PATENT DOCUMENTS

| | | | | |
|---|---|---|---|---|
| DE | 3803077 | A1 * | 8/1989 | |
| DE | 29503633 | U1 * | 6/1995 | E04F 15/02022 |
| WO | 1986007008 | | 12/1986 | |
| WO | 2005056951 | | 6/2005 | |
| WO | 2005059270 | | 6/2005 | |
| WO | 2018015634 | | 1/2018 | |
| WO | WO-2018015634 | A1 * | 1/2018 | E04F 15/02044 |

OTHER PUBLICATIONS

Shock Control 2.0. Datasheet [online]. Kronos Ceramiche, 2018 [retrieved on Oct. 3, 2018]. Retrieved from <www.kronosceramiche.com> (2 pages).

TedsDixieSheds, "Swanson Big 12 Speed Square for Stringers", YouTube, Jun. 24, 2013, <https://www.youtube.com/watch?v=IMIJXq4IIbM>.

International Search Report and Written Opinion, dated Feb. 25, 2020, in related International Application No. PCT/CA2019/051571 (11 pages).

International Search Report and Written Opinion dated Jan. 29, 2020, in related International Application Application No. PCT/CA2019/051593 (9 pages).

* cited by examiner

METHODS OF CONSTRUCTING FLOATING TILE-BASED FLOORING AND STAIRCASE SYSTEMS AND COMPONENTS THEREOF

CROSS-REFERENCE

The present application claims the benefit of U.S. Provisional Patent Application No. 63/024,131 entitled METHODS OF CONSTRUCTING FLOATING TILE-BASED FLOORING AND STAIRCASE SYSTEMS AND COMPONENTS THEREOF, filed May 13, 2020, the entirety of which is incorporated herein by reference.

TECHNICAL FIELD

The embodiments disclosed herein relate generally to flooring and staircase systems and in particular to methods of constructing floating tile-based flooring and staircase systems and components thereof.

BACKGROUND

Traditional tile floors required tiles to be physically bonded or mounted to a structural base by an adhesive, mortar, or some sort of fastener such as screws, clips or staples. Over the past decade, floating cement pavers or thick porcelain tiles (e.g. about 1.5 cm thick) on a purposefully constructed structural base have become more common. However, when the structural base is elevated from the surrounding grade (as in the case of a deck), the edges of the floating tiles around a perimeter of the structural base are exposed. This provides for the floating files to slide laterally on the structural base.

In addition to the above, the edges of structural bases, like decks, are commonly finished in a robust and aesthetically pleasing manner. One common solution for finishing the edges of a structural base is to install a coping or skirting detail. Traditionally, coping and/or skirting placed at the edge of a structural base is made of wood, a plastic composite or traditionally mortar-set mineral based tiles. Unfortunately, none of these systems lend themselves to being used with a floating tile installation. Further, wood and plastic do not generally meet the quality requirements of the consumer who is making the decision to invest in a porcelain tile flooring system.

In addition to the above, conventional methods of installing tile floors using an adhesive mortar and grout is technically difficult, slow, expensive and they do not align well with the technical skills of professional floating floor installers.

Lastly, mortar-setting vertical skirting tiles and special purpose profiles for coping and skirting applications require specialized tools and skills that are beyond the ability of most installers that might be contemplating installing a floating mineral tile system.

Professionals that build and renovate decks are typically framers and carpenters. Generally, framers and carpenters work with wood and woodworking equipment. Working with porcelain tile requires a completely different knowledge base and tool set. There is a need for a floating tile system as well as coping and skirting systems that can be consistently and efficiently installed in new construction or renovation projects of exterior decks or other structures by traditional installation professionals. Further, the there is also a need for similar systems that can be used for staircases. These systems should be renovation friendly and could be employed when existing structures are structurally sound but past their useful life from an aesthetics perspective. These systems could also be installed to protect and preserve the structure from degradation as a result of exposure to sun. A system of this sort would also be welcome in new construction projects.

In view of the above, there is clearly a need for new floating tile system for covering floors and staircases, and components thereof.

SUMMARY

In accordance with a broad aspect, a system for covering a structural base is described herein. The system includes a plurality of floating field tiles arranged to cover a top surface of the structural base; a mat positioned between a bottom surface of at least one of the floating field tiles and a top surface of the structural base to separate the bottom surface of the floating field tile from the top surface of the structural base; and a coping system secured to the top surface of the structural base. The coping system has an upper edge that is level with or below a top surface of the floating field tiles and forms a fixed perimeter around the plurality of floating field tiles to inhibit lateral movement of the plurality of floating field tiles.

In at least one embodiment, the coping system includes a plurality of coping brackets secured to the top surface of the structural base and a plurality of coping tiles mounted on the plurality of coping brackets such that an upper edge of each of the coping tiles is positioned to be level with or below a top surface of the floating field tiles.

In at least one embodiment, each of the coping brackets is configured to support one or more of the coping tiles so that each of the coping tiles is positioned in front of and spaced apart from a side surface of the structural base.

In at least one embodiment, each of the coping brackets includes a mounting portion configured to be secured to the top surface of the structural base, the mounting portion having a mounting edge to determine a position for mounting the coping bracket, a coping lip positioned in front of the mounting portion to support one or more of the coping tiles, and a downward hanging depending portion coupled to the mounting portion, the depending portion being a face on which to apply a flexible adhesive.

In at least one embodiment, when the mounting edge of the mounting portion of each coping bracket is aligned along a datum line established using a coping jig, the coping lip of each coping bracket is coplanar with each other coping lip of each other coping bracket.

In at least one embodiment, the system also includes a plurality of edge tile supports positioned around the perimeter and underneath the floating field tiles and a plurality of bedding pads, each bedding pad positioned on top of one of the plurality of edge supports to support the floating field tiles at an edge of the structural base. In at least one embodiment, a thickness of the edge tile support plus a thickness of the bedding pad is the same as a thickness of the mat.

In at least one embodiment, the system also includes a plurality of bedding pads, each bedding pad being positioned on the mounting portion of one of the coping brackets to support the floating field tiles at an edge of the structural base. In at least one embodiment, a thickness of the mounting portion plus a thickness of the bedding pad is the same as a thickness of the mat.

In at least one embodiment, the coping lip is positioned on the downward hanging depending portion to provide for the upper edge of the one or more coping tiles mounted thereon to be level with or below the top surface of the floating field tiles.

In at least one embodiment, the plurality of coping tiles are mounted onto the plurality of coping brackets by a flexible adhesive applied to a front surface of the coping brackets.

In at least one embodiment, the system also includes a skirting system, the skirting system having a plurality of skirting brackets secured to the structural base, a plurality of skirting clips secured to the structural base and a plurality of skirting tiles mounted on skirting lips of the plurality of skirting brackets and retained in front of a side surface of the structural base by the plurality of skirting clips.

In at least one embodiment, the skirting system is mounted to a side surface of the structural base and the coping system is mounted to the top surface of the structural base and is independent of the skirting system.

In at least one embodiment, the skirting bracket is configured to be mounted to a side surface of the structural base when a portion of the skirting bracket is against a bottom surface of a rim joist of the structural base.

In at least one embodiment, the coping bracket is mounted to the top surface of the structural base at a position to provide for a gap between a rear surface of the coping tiles and a front surface of the skirting tiles.

In at least one embodiment, the system also includes a plurality of spacers positioned between adjacent coping tiles of the plurality of coping tiles and between adjacent skirting tiles of the plurality of skirting tiles.

In at least one embodiment, the system also includes a plurality of spacers positioned between adjacent floating field tiles of the plurality of floating field tiles, the spacers being configured to space the adjacent tiles apart from each other and maintain a consistent gap between the adjacent floating field tiles and restrain lateral movement of the floating field tiles.

In at least one embodiment, at least two spacers are positioned between each pair of adjacent floating field tiles of the plurality of floating field tiles.

In at least one embodiment, each of the plurality of spacers has a height that is less than about one half of a thickness of each of the floating field tiles and each of the plurality of spacers is positioned nearer to a bottom surface of the floating field tiles than to a top surface of the floating field tiles to hide the spacers from view of a person on the top surface of the floating field tiles.

In at least one embodiment, each of the plurality of spacers is shaped to taper from a base of the spacer towards a tip of the spacer.

In at least one embodiment, the system also includes a waterproof membrane positioned between a bottom surface of the mat and the top surface of the structural base.

In at least one embodiment, the waterproof membrane covers the top surface of the structural base to collect water falling from a top surface of the plurality of floating field tiles and overhangs an edge of the structural base to direct the water over the edge of the structural base and behind the plurality of coping tiles.

In accordance with a broad aspect, a method of covering a structural base with a plurality of floating field tiles is described herein. The method includes determining a position of a coping system forming a perimeter around the plurality of floating field tiles, the coping system including a plurality of coping brackets and a plurality of coping tiles, the position of the coping system providing for the plurality of coping tiles to be spaced apart from side surfaces of the structural base when the plurality of coping tiles are supported on the plurality of coping brackets, mounting the plurality of coping brackets onto the top surface of the structural base at the position, installing the plurality of coping tiles on the plurality of coping brackets, installing a plurality of edge tile supports along an edge of the structural base, installing a plurality of bedding pads on the coping brackets and edge-tile supports, and installing the floating field tiles within the perimeter on a top surface of the structural base to cover the structural base using mats and shims.

In accordance with a broad aspect, a jig for installing a coping system on a stair tread is described herein. The jig includes a plurality of markings indicating a position of one or more coping brackets and tile retainers on the stair tread when the jig is fastened to the stair tread.

In accordance with a broad aspect, a jig for positioning a coping system on a structural base is described herein. The jig includes a lower portion for positioning the jig against a side surface of the structural base; and an upper edge that extends over an edge of the structural base when the lower portion is positioned against a side surface of the structural base, the upper edge indicating a position of a coping bracket of the coping system on the structural base.

Figure 1A:
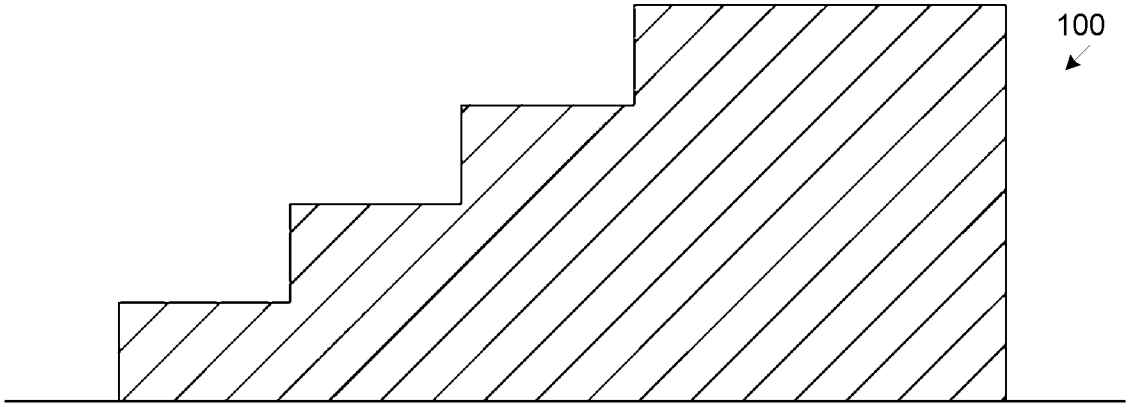
FIG. 1A is a side view of a conventional concrete deck and staircase.

The skilled person in the art will understand that the drawings, further described below, are for illustration purposes only. The drawings are not intended to limit the scope of the applicant's teachings in any way. Also, it will be appreciated that for simplicity and clarity of illustration, elements shown in the figures have not necessarily been drawn to scale. For example, the dimensions of some of the elements may be exaggerated relative to other elements for clarity. Further aspects and features of the example embodiments described herein will appear from the following description taken together with the accompanying drawings.

DETAILED DESCRIPTION

Various systems, devices and methods will be described below to provide an example of each claimed embodiment. No embodiment described below limits any claimed embodiment and any claimed embodiment may cover systems or methods that differ from those described below. The claimed embodiments are not limited to systems, devices or methods having all the features of any one system, device or method described below or to features common to multiple or all of the systems or methods described below.

It should be noted that the systems, devices and methods described herein are related to the systems, devices and methods described in U.S. Provisional Patent Application No. 62/757,375 entitled "Modular Coping and Skirting Systems for Tile Decks and Stairs", filed Nov. 8, 2018; Patent Co-operation Treaty Application No. PCT/CA2019/051592 entitled "Modular Floating Tile, Coping and Skirting Systems for Decks and Stairs", filed Nov. 8, 2019; U.S. Provisional Patent Application No. 62/757,434 entitled "Variable Rise and Fixed Run Modular Staircase Systems", filed Nov. 8, 2018; Patent Co-operation Treaty Application No. PCT/CA2019/051571 entitled "Modular Staircase Systems", filed Nov. 5, 2019; U.S. Provisional Patent Application No. 62/652,391 entitled "Outdoor Floor Construction", filed Apr. 4, 2018; U.S. Provisional Patent Application No. 62/779,816 entitled "Systems and Methods for Tile Floor Constructions", filed Dec. 14, 2018; and Patent Co-operation Treaty Application No. PCT/CA2019/050406 entitled "Systems and Methods for Tile Floor Constructions", filed Apr. 3, 2019, the entire contents of which are each incorporated by reference herein.

In at least one embodiment, one or more of the systems and methods described herein include a plurality of floating tiles (e.g. porcelain tiles) being placed on a top surface of a structural base. In at least one embodiment described herein, the systems and methods provide a rigid perimeter for a field of floating tiles positioned on a structural base that inhibits lateral movement of the floating field tiles. The rigid perimeter includes one or more components that are mounted to the structural base and adjacent to one or more side surfaces of the structural base.

Herein, it should be understood that the term "perimeter" when used with respect to the structural base refers to at least one side of the structural base. The term "perimeter" is not intended to mean all sides of a structural base. It should be understood that other features may be present on one or more sides of the structural base that inhibit the lateral movement of the floating field tiles, such as but not limited to a wall.

The structural base may be at least partially covered with the field of floating tiles, including but not limited to a pressure treated deck, a concrete deck or porch or stair treads. In at least one embodiment, the floating tiles substantially cover the top surface of the structural base.

In at least one embodiment, the tiles for use with the systems and methods described herein can be described as finely manufactured tiles that have been worked until squared. The tiles used in the systems and methods described herein are precisely processed on all faces adjacent to those of other neighboring tiles. Therefore, the tiles used in the systems and methods described herein can be installed with very thin (e.g. 2 mm) gaps between each other. In exterior applications, gaps between tiles can facilitate water drainage. Further, the visible face of the tiles used in the systems and methods described herein may have many distinct aesthetics and textures. Tiles can be installed utilizing a repeating pattern (e.g. an Ashlar pattern or any other pattern). Tiles used in the flooring applications described herein are typically laid in patterns having 3, 4 or 5 different tile sizes and these various sizes must have strict dimensional tolerance for utility.

The systems and methods described herein may be particularly directed to users that are renovating existing structural bases and wish to cover them with systems that, for instance, can withstand seasonal expansion and contraction (e.g. in three dimensions) of a wooden structural base. Further, the systems described herein are intended to provide for movement of the components that is imperceptible to pedestrians walking thereon. To pedestrians the systems always feels rigid and solid. The systems and methods described herein are designed to provide relatively simple installation and, in at least some embodiments, to minimize the need to cut the floating tiles that are used to cover the top surface of the structural bases. To accomplish this, one or more floating tile decking systems are described herein to provide for floating tiles (e.g. porcelain tiles) to be placed on a top surface of a structural base. The floating tile decking systems include a coping system that provides a rigid frame around the floating tiles to laterally support the floating tiles, and optionally other components of the system. The coping system also provides for correcting the dimensions of existing structural bases to provide square corners (i.e. having right angles). This is important because the floating tiles intended to be positioned on the top surface of the structural base are machined to have precise dimensions. The coping system provides for laterally or outwardly adjusting a mounting position of coping brackets of the coping system relative to the side surfaces of the structural base. The coping system, being mounted to the structural base, provides a rigid frame to laterally support the floating tiles of the floating tile system and can be positioned to accommodate dimensionally to minimize a need for cutting tiles.

For instance, pressure-treated decks may be renovated with the systems and methods described herein. Dimensions of pressure-treated decks in need of renovation can vary greatly. Rarely are the frames of these structures truly square. As noted above, the length and width, thickness, flatness and/or squareness of field tiles for flooring, and of coping or skirting tiles, are very consistent. Therefore, to use rigid and large format tiles to cover a top surface of a pressure-treated structural base and to use rigid coping and skirting tiles to cover the side surfaces of the pressure-treated structural base, and for the various precisely dimensioned tiles to remain correctly positioned, level, flat, and square all while coexisting together on the same flexible base, is challenging. The systems and methods described herein accommodate for the varying dimensions and seasonal movements of existing structural bases. The systems and methods defined herein thereby provide a systematic solution to simplify a potentially challenging project.

In at least one embodiment, the systems and methods described herein provide for a structural base being renovated, such as but not limited to a pressure-treated deck, to be covered with tiles without having to remove existing deck boards. In at least one embodiment, the floating field tiles to be used to cover the structural bases described herein have a thickness of less than about one inch. In these embodiments, the thickness of the tiles (and optionally any mat or pad laid between the tiles and the top surface of the structure) having a total thickness of about one inch may provide for the top surface of the structure (e.g. deck) to be covered with tiles and not substantially increase the height of the structure. For instance, the thickness of the tiles being about one inch may provide for the tiles to be laid on top of the top surface of the structure and be placed underneath a door sill, or the like, that may overhang a portion of the structure.

The systems and methods described herein may include tiles or profiles (e.g. brackets or the like) mounted on one or more side surfaces of the structure to retain the tiles on the top surface of the structure. Accordingly, the tiles placed on the top surface of the structure may be "floating tiles" or "field tiles". Herein, the term "floating tiles" generally refers to tiles (e.g. ceramic, porcelain, marble, slate, faux wood, wood, stone or the like) that are placed on a top surface of a structural base and are unattached (e.g. by grout, mortar, fasteners or clips or the like) to the top surface of the structural base.

In addition to the above, systems and methods are described herein for constructing staircases that may be mounted to or otherwise attach to the structural bases covered by the decking systems and coping and skirting systems described herein.

Figure 1B:
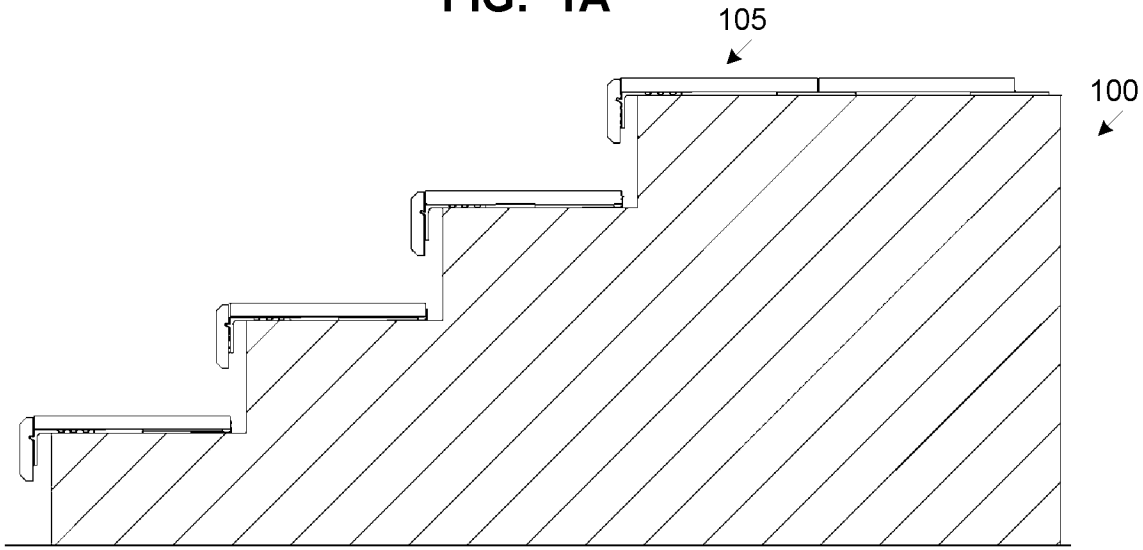
FIG. 1B is a side view of the conventional concrete deck and staircase of FIG. 1A with a floating tile system according to at least one embodiment described herein positioned thereon.

Turning to the drawings, FIG. 1A shows a side view of convention concrete stairs and a concrete porch 100. FIG. 1B shows a side view of the conventional concrete stairs and concrete porch 100 of FIG. 1A with a floating tile system 105 according to at least one embodiment described herein positioned thereon.

Figure 1C:
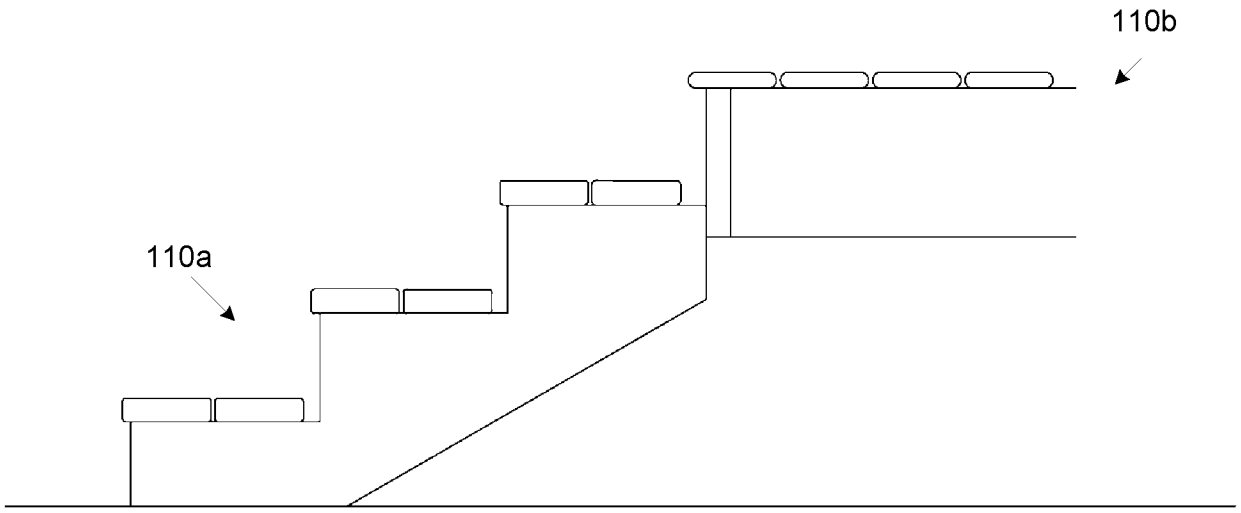
FIG. 1C is a side view of a conventional wooden deck and staircase.
Figure 1D:
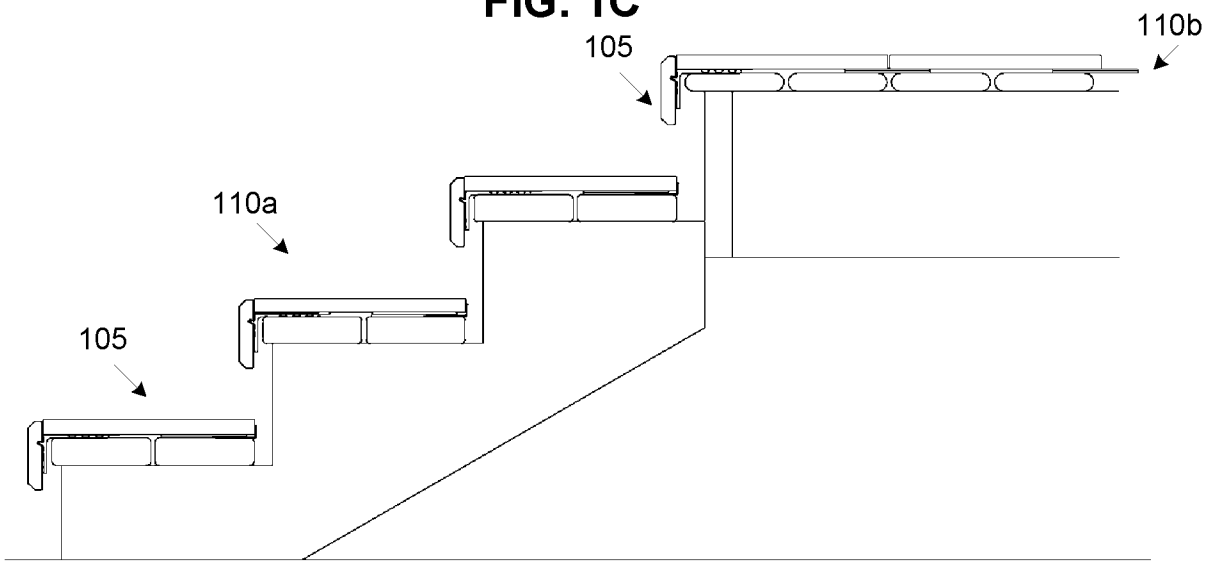
FIG. 1D is a side view of a conventional wooden deck and staircase of FIG. 1C with a floating tile system according to at least one embodiment described herein positioned thereon.

FIG. 1C shows a side view of conventional pressure-treated stairs 110*a* and a pressure-treated deck 110*b*. FIG. 1D shows a side view of the conventional pressure-treated stairs 110*a* and deck 110*b* of FIG. 1C with a floating tile system 105 according to at least one embodiment described herein positioned on each of the pressure-treated stairs 110*a* and deck 110*b*. More specifically, on the staircase 110*a* shown in FIG. 1D, each tread includes at least one floating field tile and a support structure comprising a coping bracket and a coping tile. These are each described in greater detail below. On the pressure-treated deck 110*b* shown in FIG. 1D, the floating tile system 105 includes a field of floating tiles positioned on a top surface of the pressure-treated deck 110*b*, a coping system forming a perimeter around the floating field tiles to inhibit lateral movement of the floating field tiles on the top surface of the pressure-treated deck. For clarity of illustration, reference numbers have not been included on FIGS. 1C and 1D, however, the components shown therein are described in greater detail below. The coping system includes a plurality of coping brackets that are mounted to the top surface of the pressure-treated deck 110*b* and a plurality of coping tiles that hang (e.g. are mounted on) the plurality of coping brackets. The plurality of coping tiles extend upwardly relative to the top surface of the pressure-treated deck 110*b* and an upper edge or upper boundary of the coping system (e.g. an upper edge of the coping tiles) is level with or below a top surface of the plurality of field tiles. Similarly, as shown on the treads of the stairs, the plurality of coping tiles extend upwardly relative to the top surface of the stair tread and an upper edge of the coping tile(s) is level with or below a top surface of the field tile(s) positioned on the stair treads.

The floating tile systems described herein may also include a skirting system mounted to a side surface of the structural base. It should be understood that herein, the term "side surface" or "side face" of a structural base such as but not limited to the structure of FIG. 1E means a surface extending downwardly relative to a top surface of the structural base and adjacent to an edge of the structural base. For instance, in embodiments where the structural base is a pressure-treated deck, the term "side surface" or "side face" may refer to a rim joist, or the like, of the deck. The skirting systems described herein include a plurality of skirting brackets and a plurality of skirting tiles configured to cover at least a portion of one or more side surfaces of the pressure-treated deck.

The coping systems and the skirting systems described herein, and particularly the coping brackets and the skirting brackets thereof, are configured to provide for a side surface of the structural base to be covered by the coping and/or the skirting tiles. The coping systems described herein provide a rigid perimeter around the floating field tiles to retain the floating field tiles on the top surface of pressure-treated decks and/or stair treads, for example.

Figure 1E:
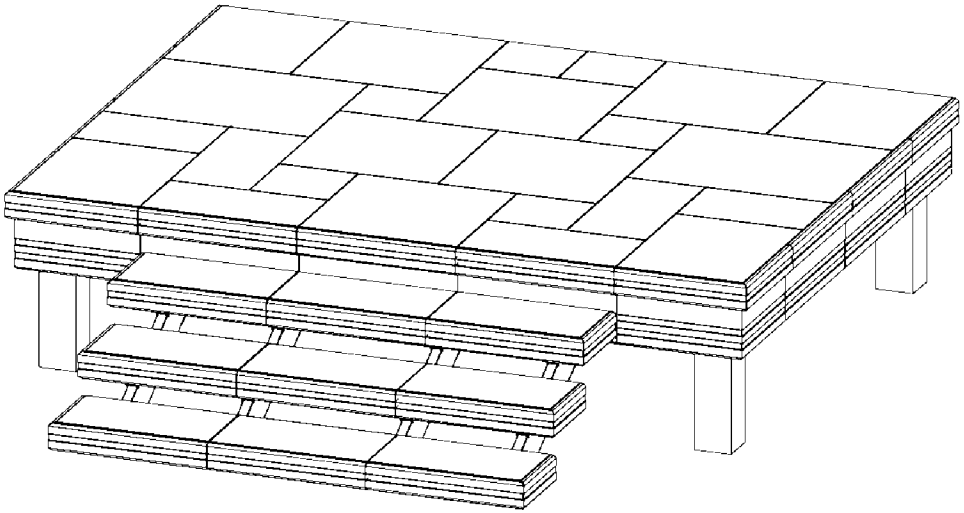
FIG. 1E is a perspective view of a structural base covered with a floating tile system according to at least one embodiment described herein positioned thereon.

FIG. 1E is an isometric view of a deck and a staircase that both have floating tile systems of at least one embodiment described herein positioned thereon. The tiles of the system are shown covering the structural base in an irregular, or ashlar pattern. When placing mineral tiles in irregular patterns such as the pattern shown in FIG. 1E, the precision sizing of the tiles is critical. As noted above, tiles are precisely processed on all faces adjacent to those of other tiles. These tiles are therefore capable of being installed with thin gaps, such as but not limited to about 2 mm, between each other to facilitate drainage. Because the tiles are precise rectangles and squares, the product must also be a precise rectangle or square. Therefore, the perimeter surrounding the field of tiles must provide a square and rigid perimeter for the field tiles and must be precisely positioned relative to the structural base. To complicate the assembly, a skirting system is sometimes desired to hide the side surface of a pressure-treated deck. The skirting systems described herein fit behind the coping system (e.g. the coping bracket) that forms the perimeter around the structural base. The skirting described herein also cover at least a portion of a side surface of the structural base. The skirting system described herein also are free draining (i.e. water may pass between the skirting tile and the side surface of the structural base (e.g. a rim joist) and are aesthetically pleasing. The assembly depicted in FIG. 1E may be free standing, be attached to a building wall or, in a different embodiment, may follow the plan view around corners of the building. In any case, a coping system is shown on all of the outwardly facing sides of the structural base. Covering stairs treads is also a challenge. The coping systems described herein adaptively configure to the needs of the installation.

Figure 2A:
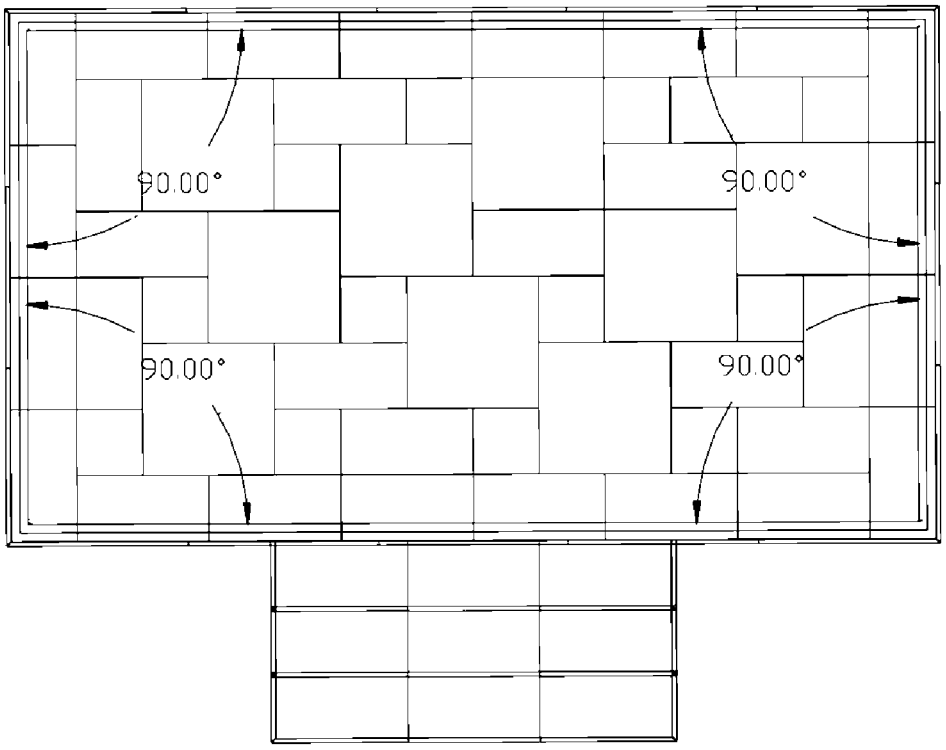
FIG. 2A is a top down view of a structural base having four 90-degree corners, and a coping systems surrounding the structural base, according to at least one embodiment described herein.
Figure 2B:
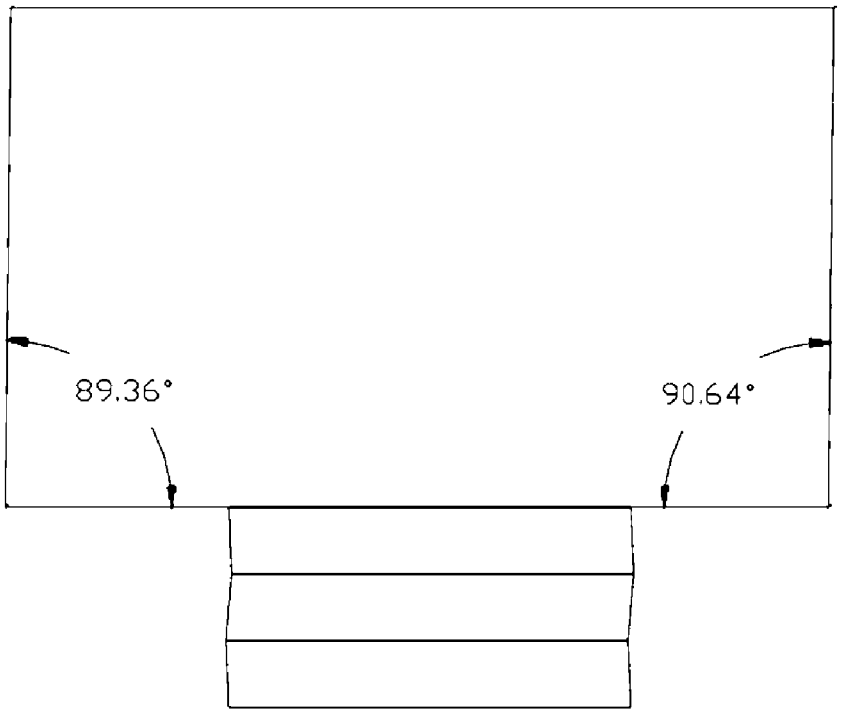
FIG. 2B is a top down view of an existing deck structure having corners that are not precisely 90 degrees.

FIG. 2A shows a top down view of a structural base having four 90-degree corners, a length and a width that define the border systems required for a typical deck project. When renovating an existing structural base, it is rare that an installer will encounter a structural base that has four 90-degree angles (they may be close, but sometimes not sufficient for a dimensionally rigid system, as shown in FIG. 2B). The size of the tiles being utilized in the project define the overall length and width dimensions required. In at least one embodiment, simple ladders as shown in FIG. 5C can be added to one or more sides of a deck to accommodate a desired length and a desired width.

Accordingly, the system described herein, in at least one embodiment, may be used to fix minor squareness issues by being installed to a precise location depending on the positioning of the floating tile field. When the floating tiles are installed on the top surface of the structural base, the last row of tiles and the adjoining coping tiles must dimensionally interact to a very tight tolerance (e.g. about 1 to 2 mm). Given that the structural base can vary dimensionally much more than this based on factors such as but not limited to construction quality, humidity levels and ground frost conditions, and that the tiles of the field are floating, the installation of the coping and skirting systems described herein can be challenging. The systems and methods described herein provide for accommodating structural bases that are not perfectly square and installing a rigid perimeter that is square.

Figure 3A:
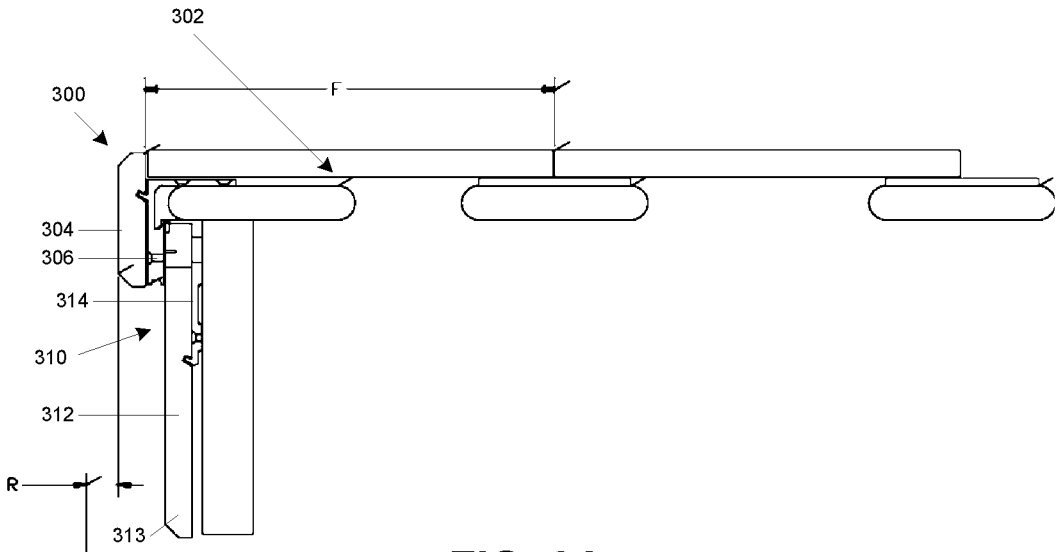
FIG. 3A is a side view of a coping system and a skirting system, according to at least one embodiment described herein.

To provide a rigid frame for the decking systems described herein, in at least one embodiment, the coping and skirting systems described herein provide for at least a portion of the skirting tile to be secured to the structural base. For instance, as shown in FIGS. 3A to 3T, the system shown therein includes a relatively short coping and skirting tile that is 39" long. By utilizing the coping and skirting system shown in FIGS. 3A to 3T, the edge of structural base is completely covered (top and sides) in tiles separated by spacers.

Figure 3B:
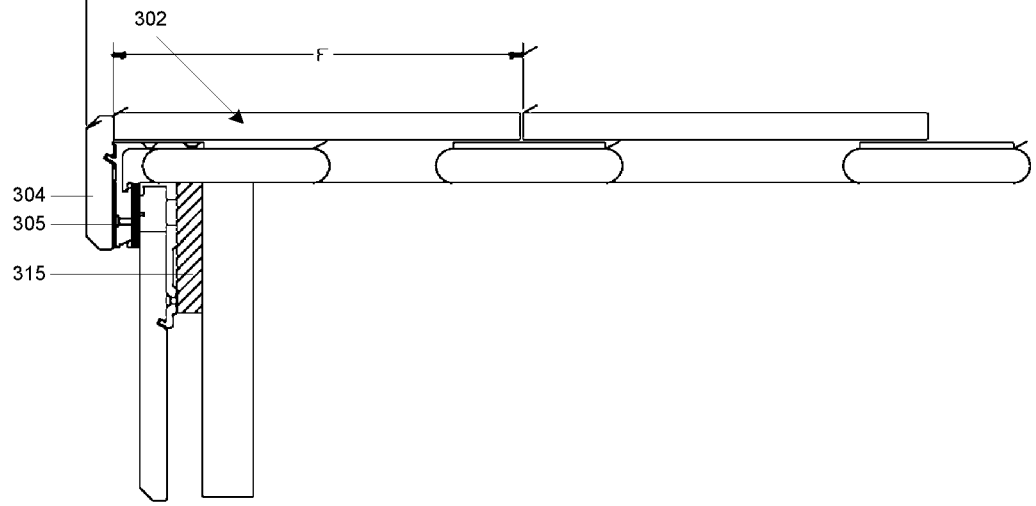
FIG. 3B is a side view of the coping systems and the skirting system shown in FIG. 3A, showing a shim positioned between the skirting bracket and the structural base.

FIGS. 3A and 3B show side views of a coping system 300 and a skirting system 310, according to at least one embodiment. As shown in FIGS. 3A and 3B, a skirting tile 312 is hung on a skirting bracket 314 and a bottom end 313 of the skirting tile 312 is floating relative to the structural base 302. The structural bases 302 of FIG. 3A and FIG. 3B are aligned with each other, however, the coping tile 304 of FIG. 3B is offset relative to the coping tile 304 of FIG. 3A by distance R. This is achieved by the coping shims 305 and skirting shims 315 shown in FIG. 3B. By using different thickness shims, the coping system 300 and skirting system 310 offers both course (e.g. thick shims) and fine (e.g. thin shims) adjustment. This feature is used to correct squareness errors on the structural base 302 and to micro adjust the distance F required for final tile.

FIG. 3A shows the system assembled in a most compact orientation (i.e. the skirting bracket 314 is not laterally spaced from the structural base 302 and the coping bracket 306 is not laterally spaced from the skirting bracket 314).

FIG. 3B shows the system assembled in a most expanded orientation by addition of shims 305 and 315.

Figure 3C:
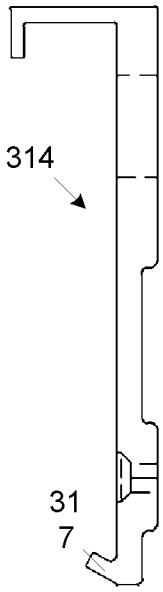
FIG. 3C is a side view of the skirting bracket of the system of FIG. 3A, according to at least one embodiment.
Figure 3D:
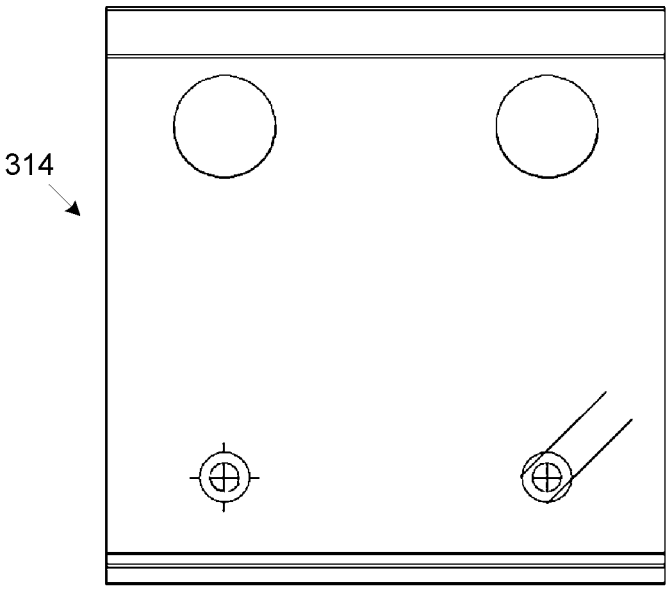
FIG. 3D is a front view of the skirting bracket of FIG. 3C.
Figure 3E:
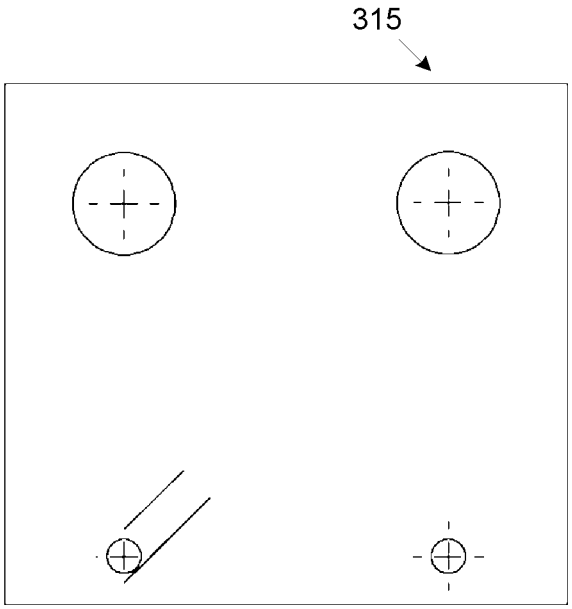
FIG. 3E is a front view of a skirting shim of the skirting system of FIG. 3A, according to at least one embodiment.
Figure 3F:
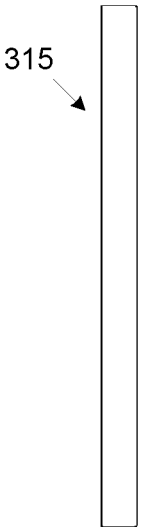
FIG. 3F is a side view of the skirting shim of FIG. 3E.
Figure 3G:
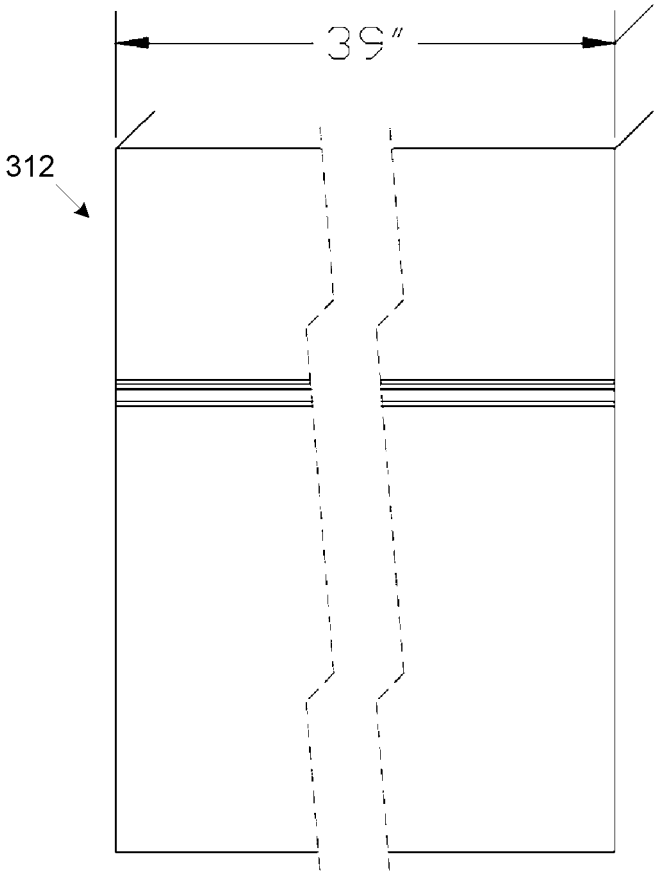
FIG. 3G is a rear view of a skirting tile of the skirting system of FIG. 3A having a width of 39" wide, according to at least one embodiment.
Figure 3H:
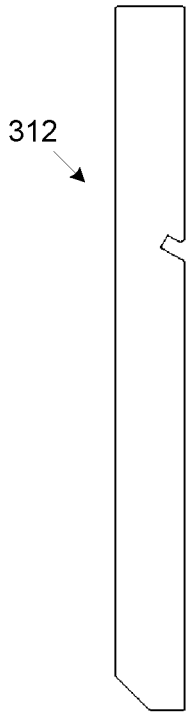
FIG. 3H is a side view of the skirting tile of FIG. 3G.
Figure 3I:
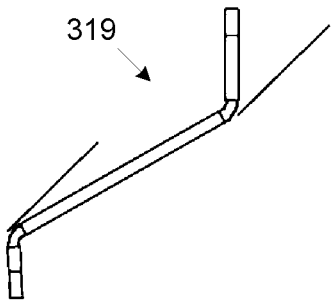
FIG. 3I is a side view of a skirting clamp of the skirting system of FIG. 3A, according to at least one embodiment described herein.
Figure 3J:
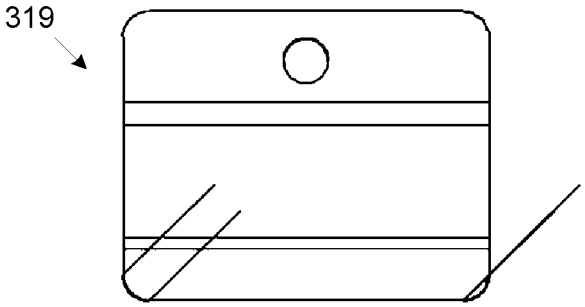
FIG. 3J is a front view of the skirting clamp of FIG. 3I.
Figure 3K:
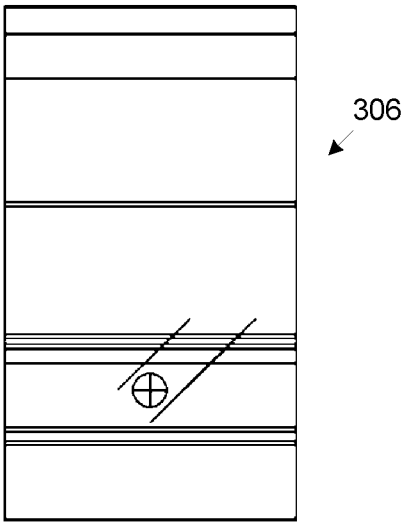
FIG. 3K is a front view of a coping bracket of the coping system of FIG. 3A, according to at least one embodiment described herein.
Figure 3L:
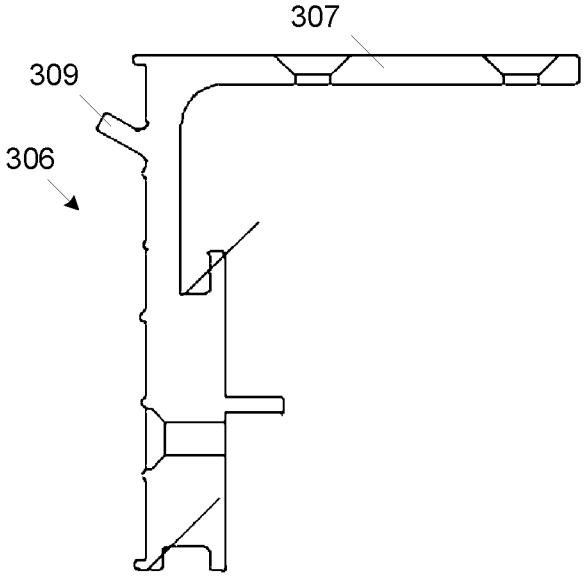
FIG. 3L is a side view of the coping bracket of FIG. 3K.
Figure 3M:
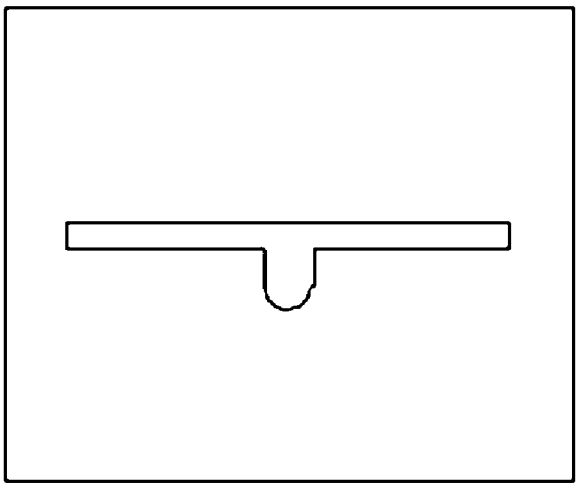
FIG. 3M is a front view of a coping shim of the coping system of FIG. 3A, according to at least one embodiment described herein.
Figure 3N:
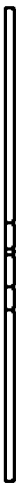
FIG. 3N is a side view of the coping shim of FIG. 3M.
Figure 3P:
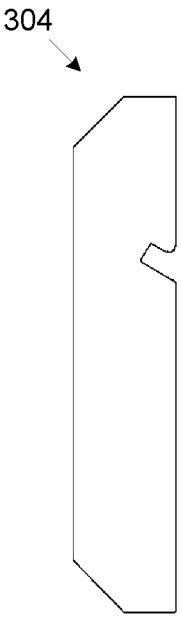
FIG. 3P is a side view of the coping tile of FIG. 3O.

FIGS. 3C to 3P show various components of the system of FIG. 3A, as presented in order of installation.

Specifically, FIGS. 3C and 3D show side and front views, respectively, of a skirting bracket 314 of the system of FIG. 3A, according to at least one embodiment. The ends of neighboring skirting tiles hang the on the lip 317 at a bottom end of the skirting bracket 314 via a groove in the rear side of each tile.

FIGS. 3E and 3F show front and side views, respectively, of a skirting shim 315 of the system of FIG. 3A, according to at least one embodiment. Skirting shims 315 such as the shim shown in FIGS. 3E and 3F are used when the coping tile 304 needs to be laterally adjusted outwardly by more than about 0.25 inches and can be stacked.

FIGS. 3G and 3H show rear and side views, respectively, of a skirting tile 312 having a width of about 39" wide of the system of FIG. 3A, according to at least one embodiment.

FIGS. 3I and 3J show side and front views, respectively, of a skirting clamp 319 of the system of FIG. 3A, according to at least one embodiment. The skirting clamp 319 is used to fasten the skirting tile 312 to the structure between the skirting brackets 314. For instance, as shown in FIG. 3R, the skirting clamp 319 may secure a top end of the skirting tile 312 to the structural base 302. The skirting clamp 319 is directly fastened to the structural base 302 to secure the top end of the skirting clamp 319 to the structural base 302. Once the skirting clamp 319 is fastened to the structural base 302, coping bracket 306 can be mounted to a top surface of the structural base 302.

FIGS. 3K and 3L show front and side views, respectively, of a coping bracket 306 of the system 300 of FIG. 3A, according to at least one embodiment. In the system 300 shown in FIG. 3A, two coping brackets 306 (such as the coping bracket shown in FIGS. 3K and 3L) are installed at each skirting bracket 314. Ends of neighboring coping tiles 304 hang on a lip 309 at the upper end of the coping bracket 306 via a groove in the back of the coping tiles 304. The coping brackets 306 shown in FIGS. 3K and 3L also include a mounting portion 307 for mounting the coping bracket 306 to a top surface of the structural base 302. In at least one embodiment, the mounting portion 307 has a thickness same as a drainage layer of the mat positioned underneath the floating tiles of a decking system covering the structural base.

FIGS. 3M and 3N show front and side views, respectively, of coping shims 305 of the system of FIG. 3A, according to at least one embodiment. The coping shims 305 can be used for fine adjustment of the field perimeter. For instance, in at least one embodiment the coping shims 305 are about 0.04 inches thick.

Figure 3O:
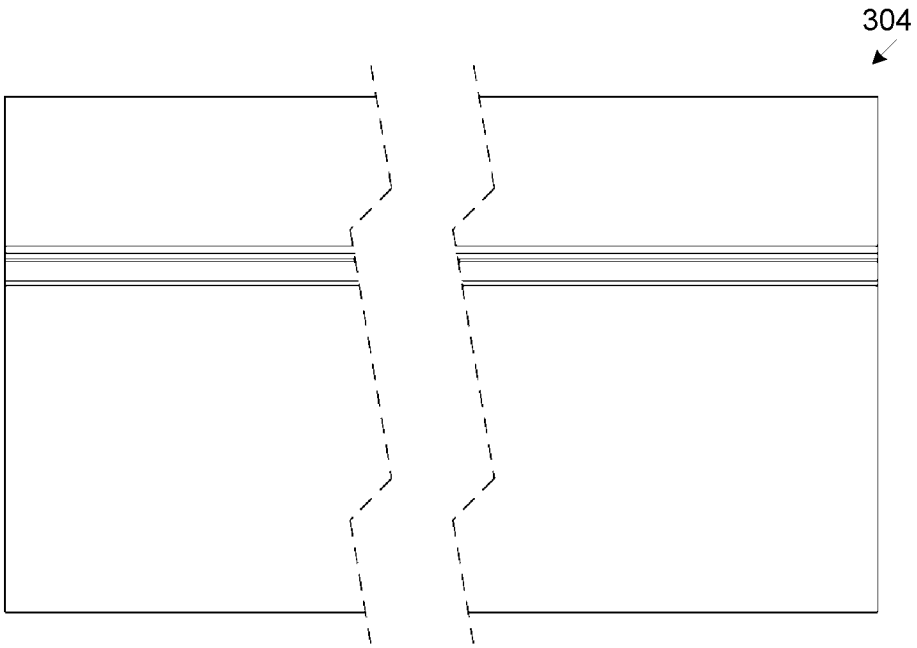
FIG. 3O is a rear view of a coping tile of the coping system of FIG. 3A having a width of 39" wide, according to at least one embodiment described herein.
Figure 3Q:
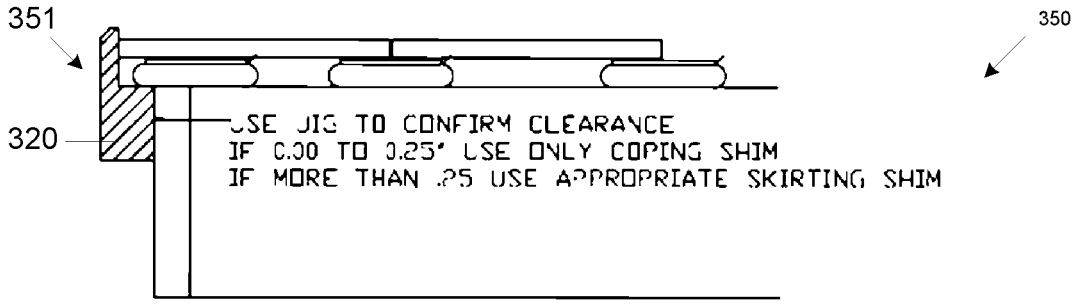
FIG. 3Q shows a first step of a method of assembling the coping system and skirting system of FIG. 3A, according to at least one embodiment described herein.
Figure 3R:
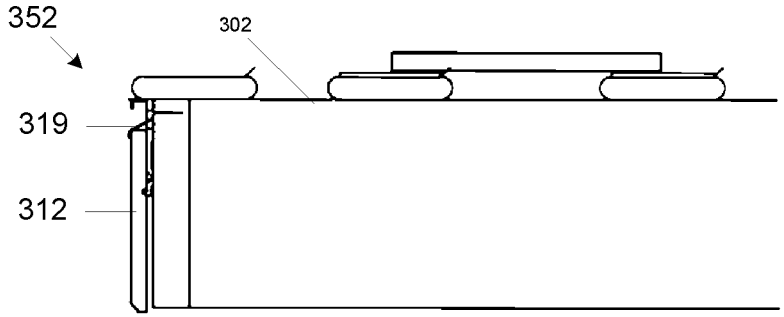
FIG. 3R shows a second step of a method of assembling the coping system and skirting system of FIG. 3A, according to at least one embodiment described herein.

FIGS. 3O and 3P show rear and side views, respectively, of a coping tile 304 being 39" wide of the system of FIG. 3A, according to at least one embodiment, After hanging a coping tile 304 on the coping bracket 306, the coping tile 304 may be fastened to the coping bracket 306 by a flexible adhesive as a final step, in the at least one embodiment.

FIGS. 3Q to 3T show steps of a method 350 of assembling the coping system 300 and the skirting system 310 of FIG. 3A, according to at least one embodiment. At a first step 351 shown in FIG. 3Q, the coping offset jig 320 is used to confirm a clearance between an edge of a field tile and a side surface of the structural base. If the clearance is 0.00 to 0.25 inches, only a coping shim(s) 305 is required to install the coping bracket 306. If the clearance is more than 0.25 inches, an appropriate skirting shim 315 should be used.

At a second step 352 shown in FIG. 3R, the skirting bracket 314 and any required shims 315 are fastened to the structural base 302, and the skirting tile 312 is mounted on the skirting bracket lip 317. To secure the skirting tile 312, a spring clamp 319 is utilized by fastening the spring clamp 319 to the structural base 302 and simultaneously securing a top portion of the skirting tile 312 against the skirting bracket 314.

Figure 3S:
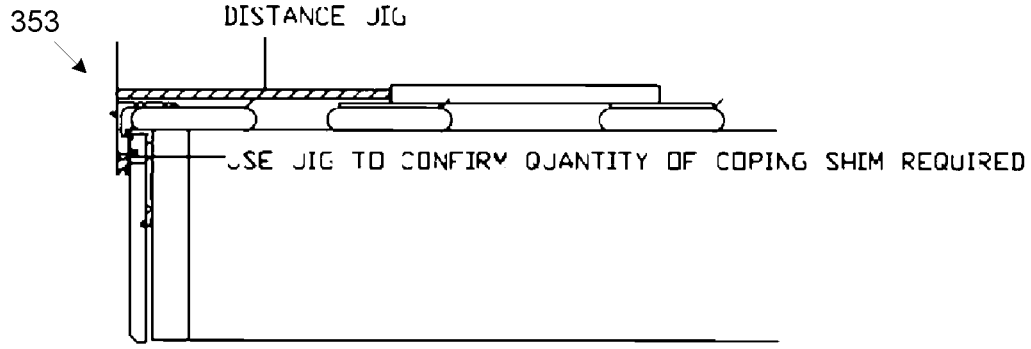
FIG. 3S shows a third step of a method of assembling the coping system and skirting system of FIG. 3A, according to at least one embodiment described herein.
Figure 3T:
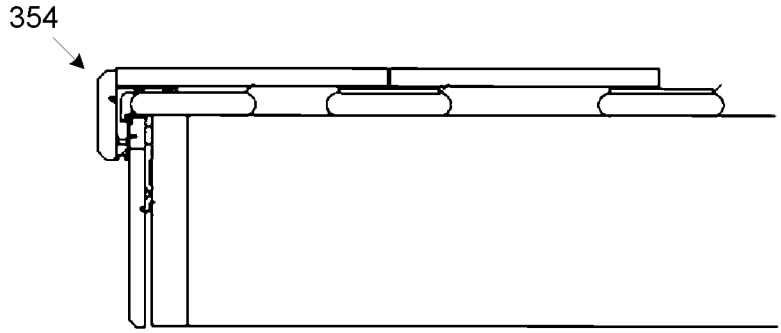
FIG. 3T shows a fourth step of a method of assembling the coping system and skirting system of FIG. 3A, according to at least one embodiment described herein.

At a third step 353 shown in FIG. 3S, the coping distance jig 321 is used to confirm the number of coping shims that are required. Following this, the coping bracket 306 is fastened to the structural base 302.

At a fourth step 354 shown in FIG. 3T, the coping tile 304 is mounted on the coping bracket lip 309 and adhered with a flexible adhesive warranted for exterior use. As a final step, the remaining field tile(s) are installed.

Figure 4A:
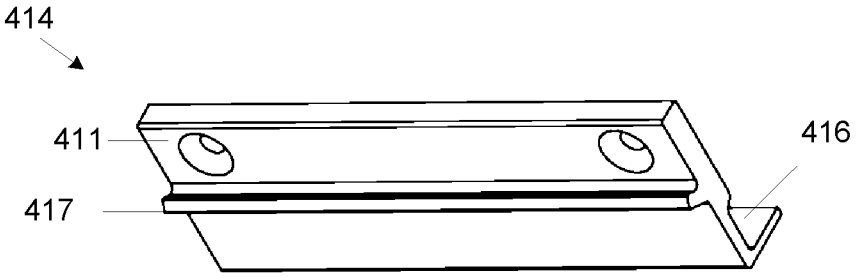
FIG. 4A is a perspective view of a skirting bracket of a skirting system that is used to mount a skirting tile to a structural base, according to at least one embodiment described herein.
Figure 4B:
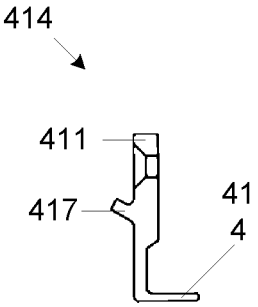
FIG. 4B is a side view of the skirting bracket of FIG. 4A.
Figure 4C:
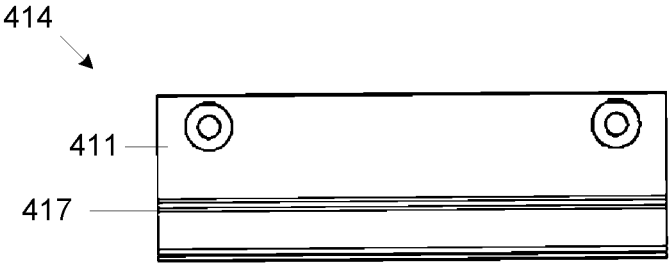
FIG. 4C is a front view of the skirting bracket of FIG. 4A.
Figure 4D:
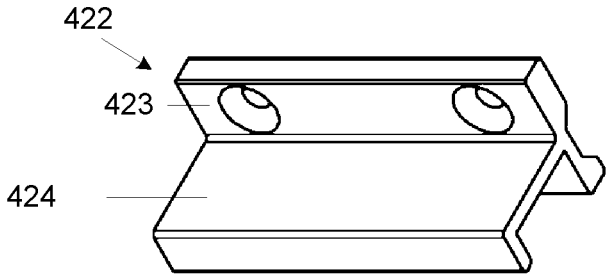
FIG. 4D is a perspective view of a skirting clip of a skirting system that is used to retain a top end of a skirting tile to a structural base, according to at least one embodiment described herein.
Figure 4E:
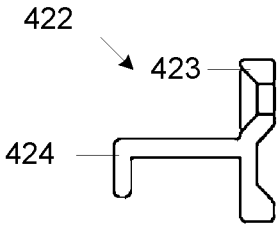
FIG. 4E is a side view of the skirting clip of FIG. 4D.
Figure 4F:
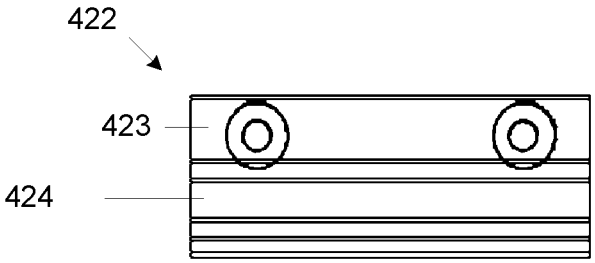
FIG. 4F is a front view of the skirting clip of FIG. 4D.
Figure 4G:
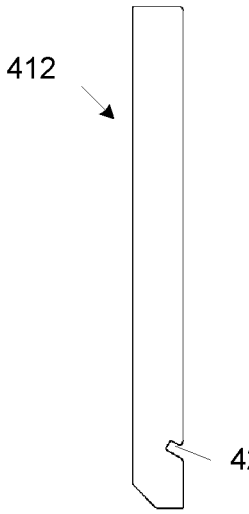
FIG. 4G is a side view of a skirting tile of a skirting system, according to at least one embodiment described herein.
Figure 4H:
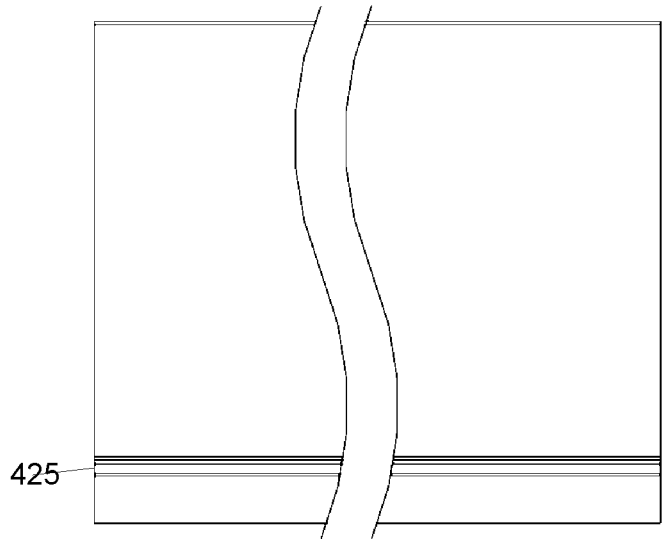
FIG. 4H is a front view of the skirting tile of FIG. 4H.
Figure 4I:
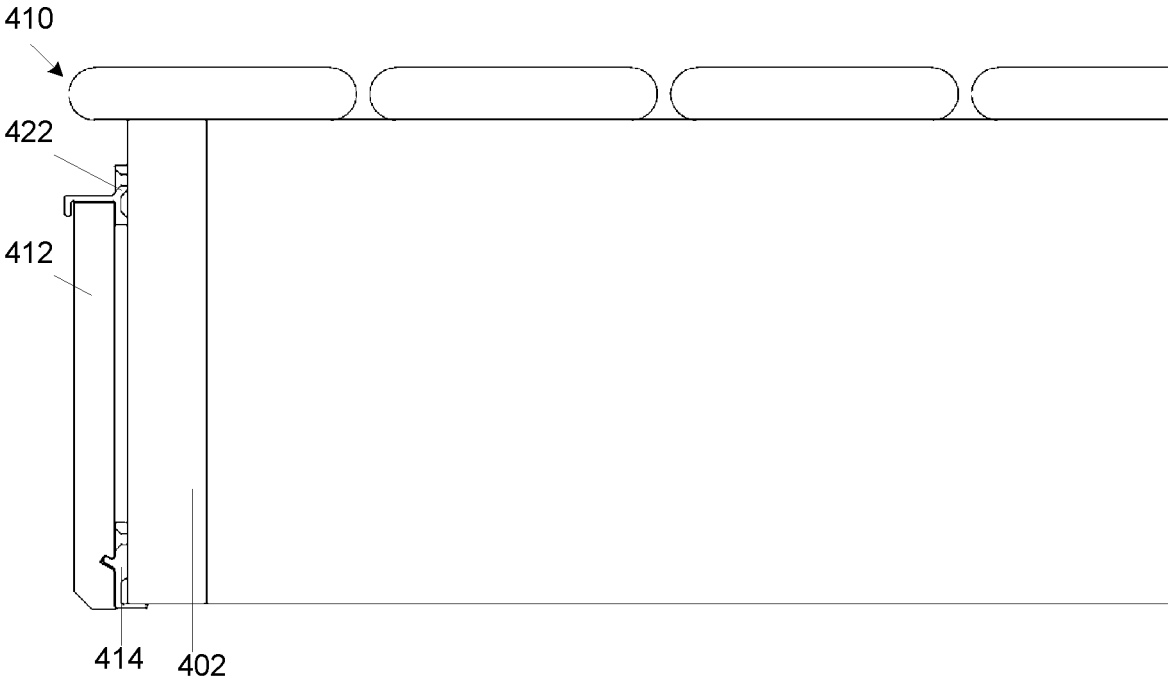
FIG. 4I is a side view of the skirting tile of FIG. 4H and the skirting clip of FIG. 4G installed on a structural base.
Figure 4J:
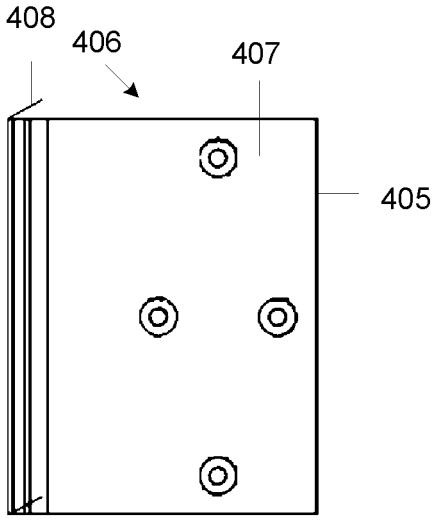
FIG. 4J is a top view of a coping bracket of a coping system according to at least one embodiment described herein.
Figure 4L:
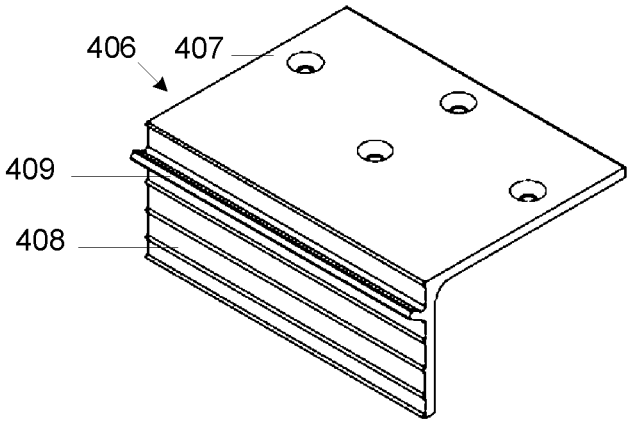
FIG. 4L is a side view of the coping bracket of FIG. 4J.
Figure 4K:
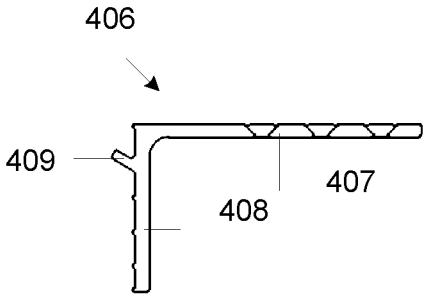
FIG. 4K is a perspective view of the coping bracket of FIG. 4J.
Figure 4N:
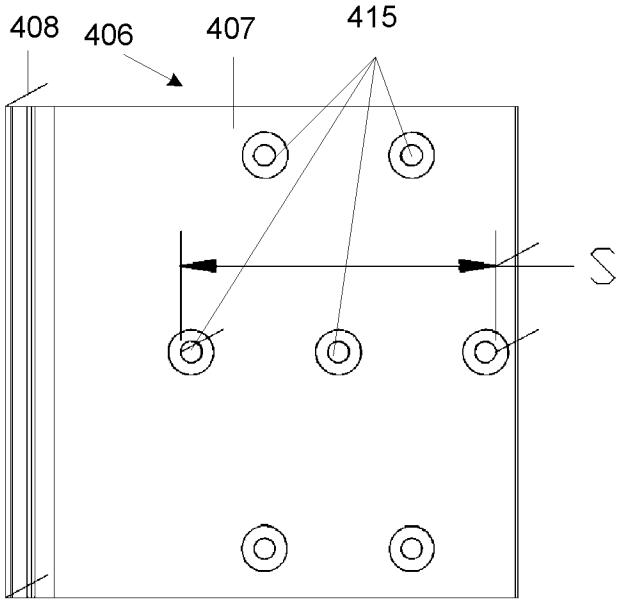
FIG. 4N is a top view of another coping bracket according to at least one embodiment described herein.
Figure 4M:
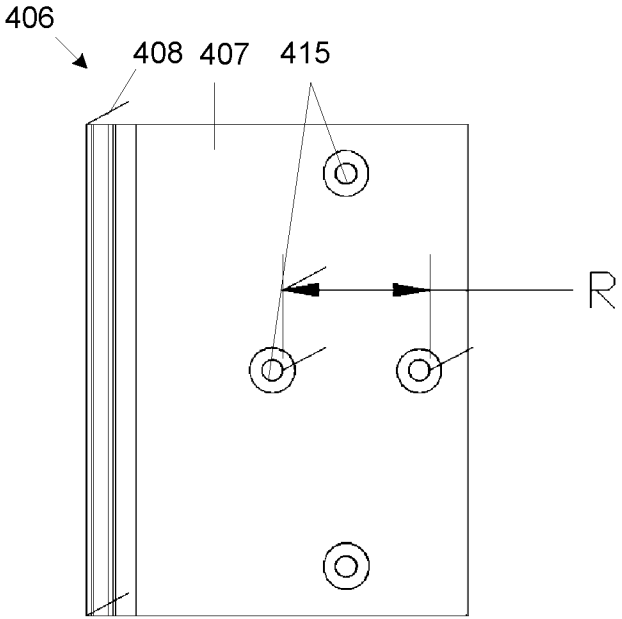
FIG. 4M is a top view of the coping bracket of FIG. 4J
Figure 4P:
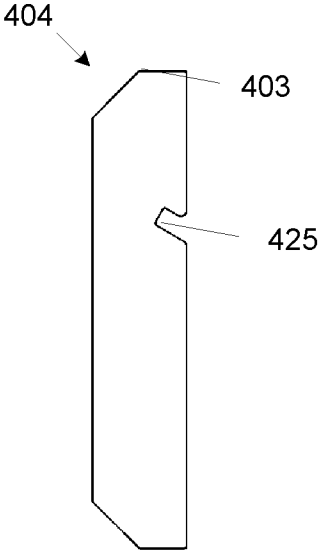
FIG. 4P is a side view of the coping tile of FIG. 4P.
Figure 4O:
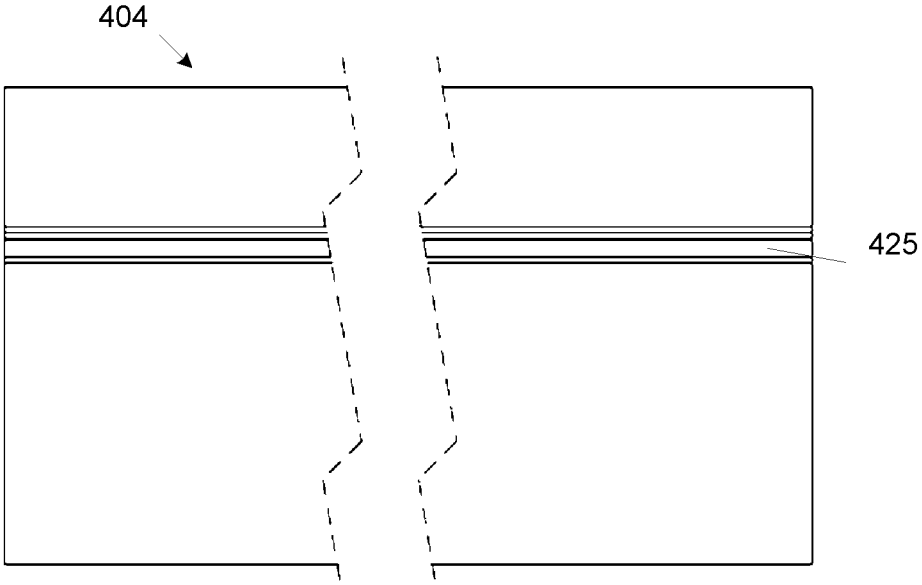
FIG. 4O is a rear view of a coping tile of a coping system according to at least one embodiment described herein.
Figure 4Q:
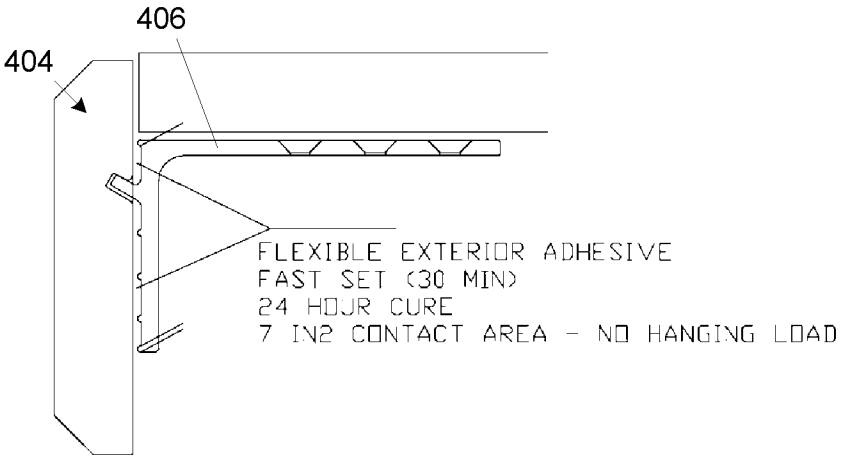
FIG. 4Q is a side view of the coping tile of FIG. 4O and the coping bracket of FIG. 4J mounted to a structural base.

FIGS. 4A to 4Q show another embodiment of a coping system 400 for forming a perimeter around a structural base 402, and another embodiment of a skirting system 410 that provides for at least a portion of a skirting tile 412 to be secured to the structural base 402. In this embodiment, components of the coping system 400 and the skirting system 410 are separate and independently of each other to position the coping and skirting tiles thereof independently. For instance, in this embodiment, the skirting tiles of skirting system 410 (described in greater detail below) are mounted to a side surface of the structural base whereas the coping tiles of coping system 400 (described in greater detail below) are attached to the top surface of the structural base.

FIGS. 4A to 4C show one embodiment of a skirting bracket 414. Skirting bracket 414 is configured to mount to a rim joist of a deck, for example. Skirting bracket 414 includes a skirting bracket lip 417 extending outwardly from a mounting portion 411 in a direction away from a front face of the structural base 402, and upwardly relative to an alignment tab 416 that extends rearwardly from the mounting portion 411. Alignment tab 416 may be positioned immediately under the rim board of the deck to position the skirting bracket 414. Mounting portion 411 includes one or more apertures for receiving fasteners for mounting the skirting bracket 412 to a front surface (or side surface) of structural base 402. Skirting bracket lip 417 is configured to be received in a matching groove extending inwardly into a rear side of a skirting tile 412 to support the skirting tile 412 thereon (e.g. in front of the front surface or side surface of structural base 402). Skirting bracket 412 is mounted on a side surface of the structural base and provides for water to pass behind a skirting tile 412 mounted thereon and the side surface of the structural base 402 (e.g. a rim joist thereof).

FIGS. 4D to 4F show one embodiment of a skirting clip 422. Skirting clip 422 is configured to mount to a rim board of a deck, for example, and retain a top portion of a skirting tile 412 in front of a front surface of the structural base 402. Skirting clip 422 includes a mounting portion 423 configured to be mounted to a front surface of the rim board (e.g. the front surface or side surface of the structural base 402) and a retaining portion 423 extending outwardly from the mounting portion 423 in a direction away from a front face of the structural base 402. Retaining portion 424 is sized and shaped to fit over a top edge of skirting tile 412 to retain the skirting tile 412 in front of the rim board. Skirting clip 422 is mounted on a side surface of the structural base and co-operates with the skirting bracket 414 to space a skirting tile 412 mounted thereon from the side surface of the structural base to provide for water to pass behind a skirting tile 412 mounted thereon and the side surface of the structural base 402 (e.g. a rim joist thereof).

FIGS. 4G and 4H show one embodiment of a skirting tile 412. Skirting tile 412 includes a groove 425 extending inwardly from a rear surface thereof, at a lower portion thereof, to be received in the support lip 417 of skirting bracket 414.

FIG. 4I shows the skirting system 410 positioned on structural base 402 as described above. Here, a gap between the skirting tile 412 and the front surface (or side surface) of the structural base 402 is shown. The gap provides for water to drain behind the skirting tile 412.

FIGS. 4J to 4L show one embodiment of a coping bracket 406. Coping bracket 406 includes a mounting portion 407 extending rearwardly from a depending portion 408 hanging downwardly therefrom.

Depending portion 408 includes a coping support lip 409. Coping support lip 409 extends away from and upwardly from depending portion 408 (e.g. from an upper portion of depending portion 408) and is sized and shaped to fit within (e.g. match) a groove in a rear side of a coping tile 404. Coping support lip 409 extends away from a front face of the depending portion 409 from an upper portion (i.e. a position that is at or above a midpoint) of the depending portion 408.

Mounting portion 407 may include one or more apertures each sized and shaped to receive a fastener for mounting the coping bracket 406 to a top surface of structural base 402. Mounting portion 407 may have a same thickness as a drainage layer of a mat or a tile edge support (described in greater detail below) and be sized and shape to be positioned underneath a floating field tile to support the floating field tile thereon. Mounting portion 407 includes a rear edge 405 extending a width of the coping bracket 406. Rear edge 405 is configured to be used to position the coping bracket 406, for instance along an alignment line (i.e. datum line) of a top surface of a structural base. Rear edge 406 is parallel with depending portion 408 and lip 409.

FIG. 4M shows a top view of the coping bracket 406 and apertures 415 of the mounting portion 407. FIG. 4N shows another embodiment of coping bracket 406 having a larger mounting portion 407. For example, mounting portion 407 extends rearwardly from depending portion 408 a greater distance than the mounting portion 407 of the coping bracket 406 of FIG. 4M. In the embodiment shown in FIG. 4N, mounting portion 407 is configured to accommodate a greater number of apertures 415, thereby providing for the coping bracket 406 of FIG. 4N to be mounted on a top surface of a structural base at a position that provides for the depending portion 408 to be spaced from a side surface of the structural base a greater distance than is provided by the coping bracket 406 of FIG. 4M.

FIGS. 4O and 4P show one embodiment of a coping tile 404. Coping tile 404 includes a groove 426 extending inwardly from a rear surface thereof, at an upper portion thereof, to be received in the support lip 409 of coping bracket 406. FIG. 4Q shows one embodiment of a coping tile 404 mounted on a coping bracket 406. As noted on FIG. 4Q, an adhesive may be used to maintain the coping tile 404 being mounted on the coping bracket 406. In at least one embodiment, the adhesive is generally a flexible adhesive having a thickness of about 1-2 mm, a fast setting time (e.g. about 30 minutes) and, optionally, about a 24-hour cure time. For instance, the adhesive may have a stiffness about equal to a stiffness of the spacers of the system (described in greater detail below). The adhesive may be applied to a front face of the coping bracket. Coping tile 404 also has an upper edge 403. In at least one embodiment, upper edge 403 forms an upper boundary of the coping system.

Figure 4R:
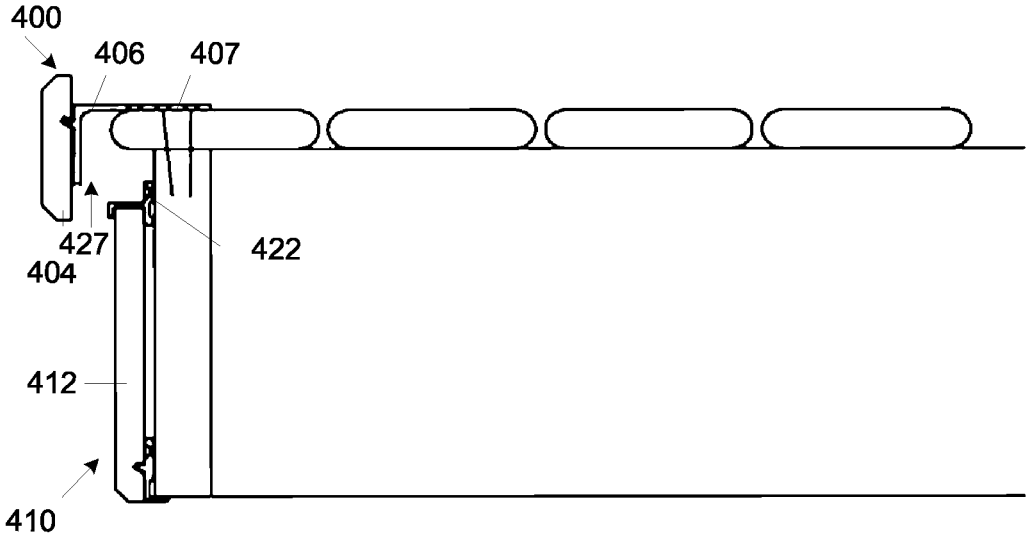
FIG. 4R is a side view of the coping system of FIG. 4Q and the skirting system of FIG. 4I mounted to a structural base showing the coping bracket at an outermost position relative to a side surface of the structural base.
Figure 4S:
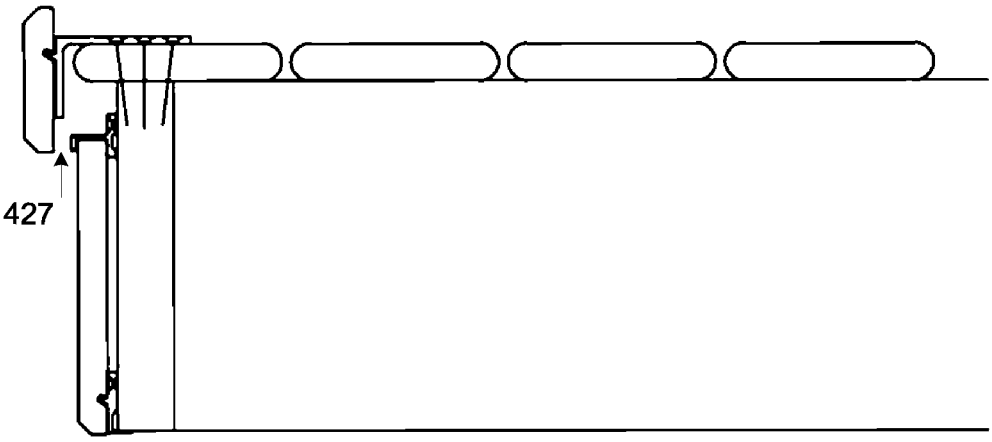
FIG. 4S is a side view of the coping system of FIG. 4Q and the skirting system of FIG. 4I mounted to a structural base showing the coping bracket at an intermediate position.
Figure 4T:
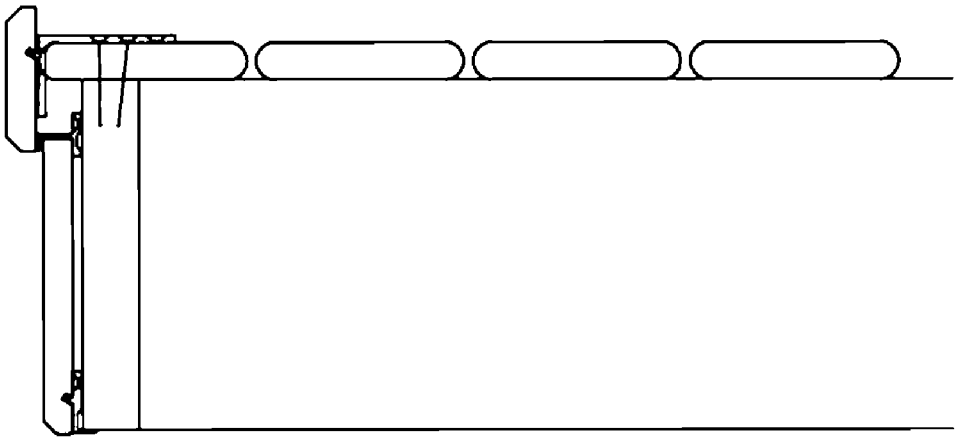
FIG. 4T is a side view of the coping system of FIG. 4Q and the skirting system of FIG. 4I mounted to a structural base showing the coping bracket at an innermost position relative to a side surface of the structural base.

FIGS. 4R to 4T show that the coping bracket 406 and coping tile 404 can form a fixed perimeter around the structural base 402. Coping bracket 406, and specifically mounting portion 407, can be used for fine adjustment of a position of the perimeter of the structural base 402. For instance, FIG. 4R shows the coping bracket 406 mounted to a top surface of structural base 402 and extending outwardly from a front surface (or side surface) thereof to provide a gap 427 between a rear surface of coping tile 404 and a front surface of skirting tile 412. In at least one embodiment, gap 427 can provide for water to drain therethrough. FIG. 4S shows a narrower gap 427 relative to FIG. 4R. FIG. 4T shows the coping tile 404 positioned such that a rear face thereof is contacting a front face of the skirting clip 422. This arrangement maintains a free water channel.

Figure 4U:
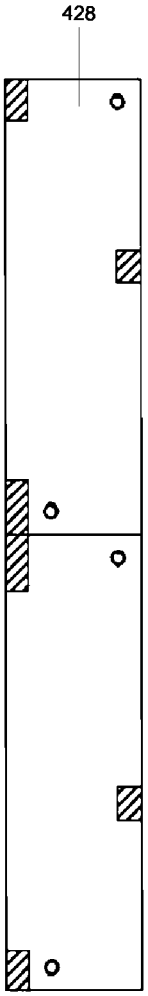
FIG. 4U is a top view of a jig for use in installing a coping system according to at least one of the embodiments described herein on a stair tread.
Figure 4V:
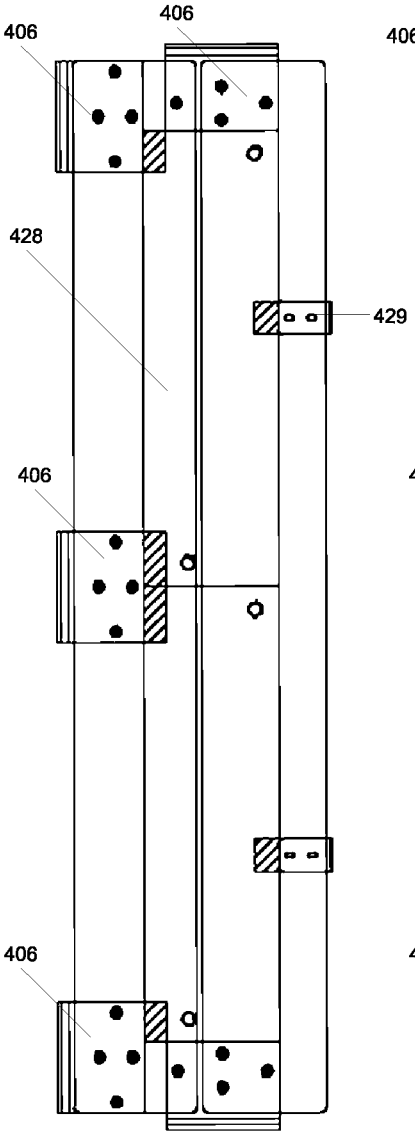
FIG. 4V is a top view of the jig of FIG. 4U positioned on a stair tread.
Figure 4X:
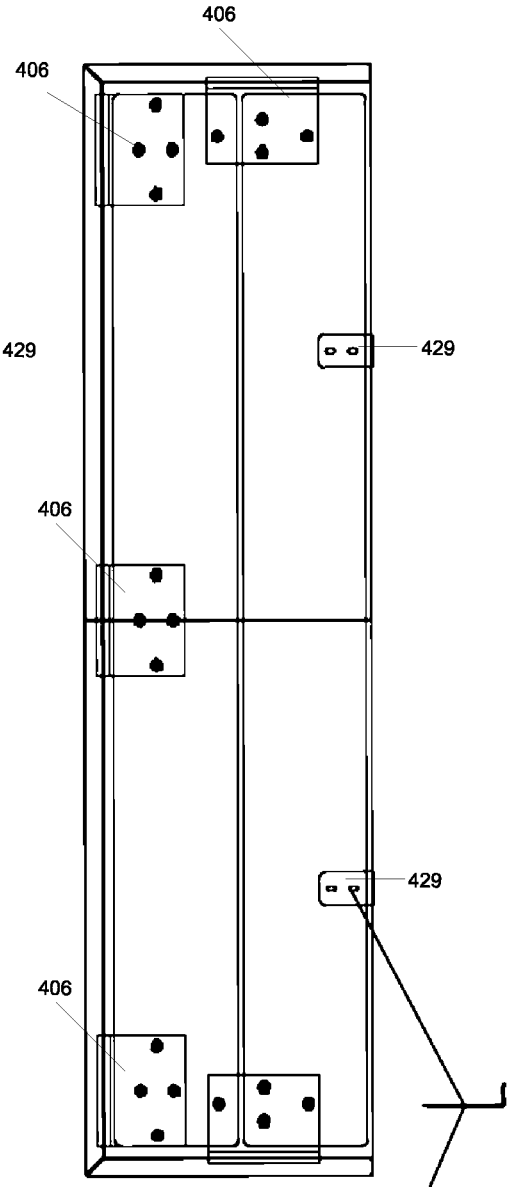
FIG. 4X is a top view of a stair tread having a coping system according to at least one of the embodiments described herein having been installed using the jig of FIG. 4V.

FIG. 4U shows a jig 428 for installing a coping system described herein to a stair tread. For example, As shown in FIG. 4V, jig 428 can be fastened to a top surface of a stair tread and used to abut components of the coping system that are to be mounted to a top surface of the stair tread. These components may include coping brackets 406 as well as tile retainers 429. Tile retainers 429 may also form part of a perimeter around a top surface of a stair tread, be mounted to the top surface of the stair tread and retain one or more floating tiles on the top surface of a stair tread or support structure. The components can be mounted to the top surface of the stair tread when aligned with markings on the jig 428 as shown in FIG. 4V. This makes the process of installing the perimeter coping brackets and building treads, systematic, repeatable and efficient.

Figure 4W:
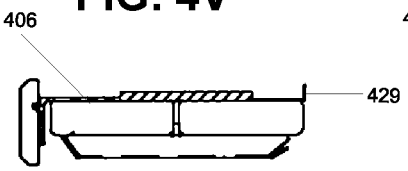
FIG. 4W is a side view of the stair tread of FIG. 4V.
Figure 4Y:
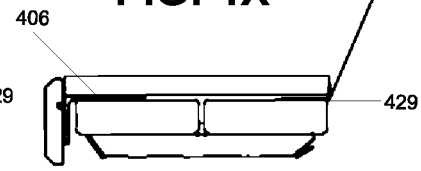
FIG. 4Y is a side view of the stair tread of FIG. 4X.

FIG. 4W shows a top and end view of the finished stair tread with brackets copings and filed tiles installed properly.

Figure 5A:
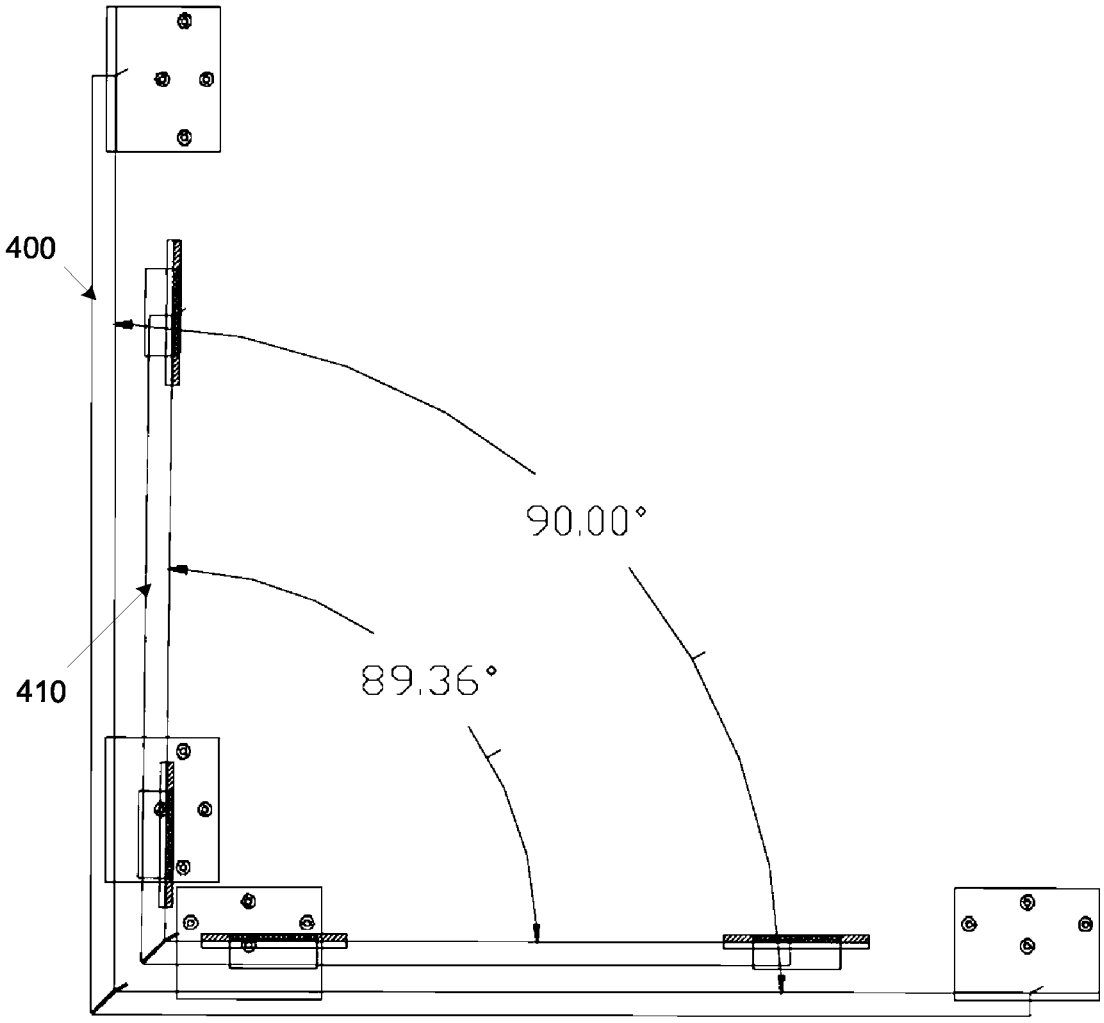
FIG. 5A is a top view of a structural base having a coping system according to at least one embodiment described herein forming a 90° angle in a corner and a skirting system according to at least one embodiment described herein forming an 89.36° angle in the same corner.

FIG. 5A shows how the coping system 400 can be used to finely adjust a position of a perimeter of the structural base 402. Here, the skirting system 410, which is mounted directly to a side surface of the structural base 402, forms an 89.36° angle around a corner of the structural base 402. By adjusting a position of the coping brackets 406 on the top surface of the structural base 402, an installer can achieve a 90° angle around the same corner for installation of floating field tiles thereon with the coping systems described herein.

Figure 5B:
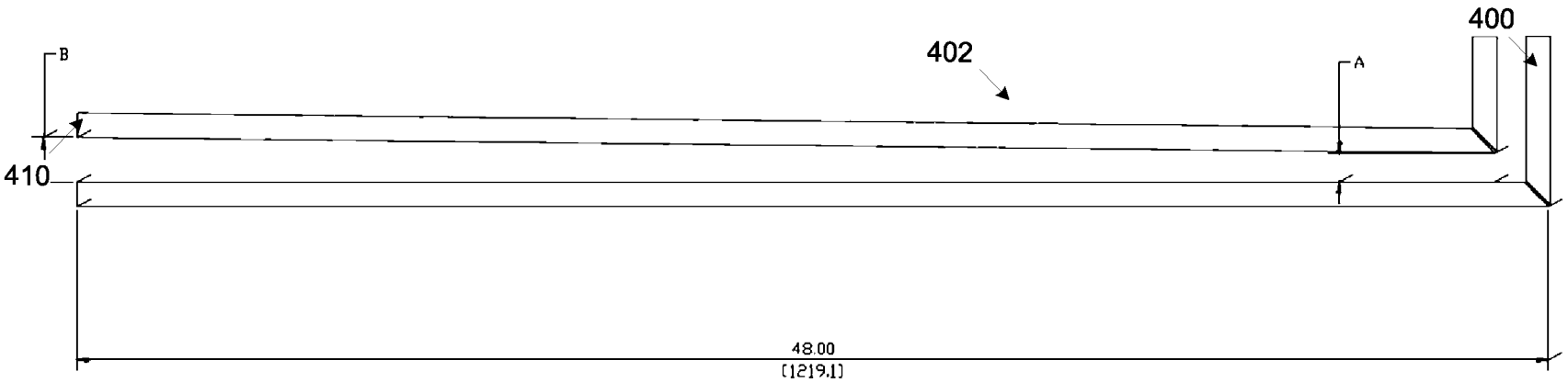
FIG. 5B is a top down view of the structural base of FIG. 5A showing the coping and skirting systems.
Figure 5C:
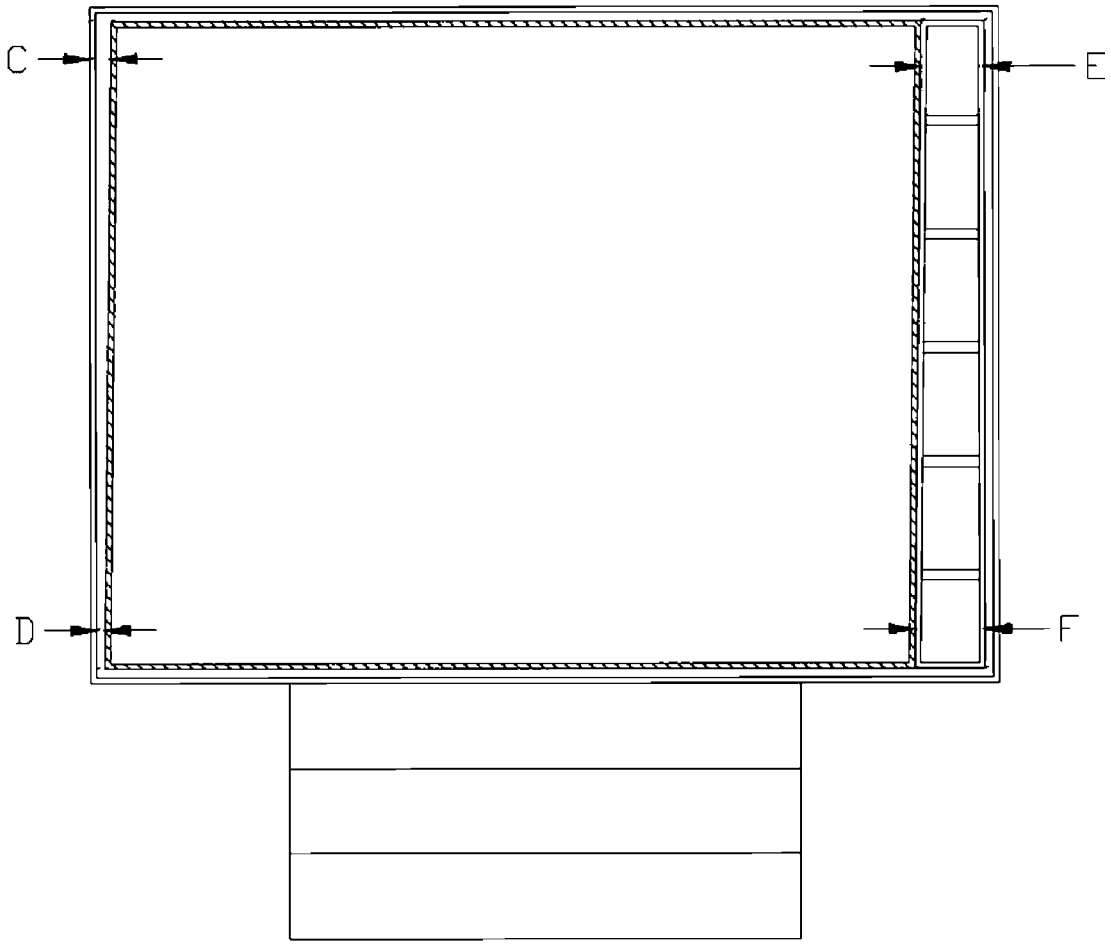
FIG. 5C is a top view of a deck and a staircase having a coping system according to at least one embodiment described herein positioned thereon and a ladder attached thereto to extend a perimeter of the system.

FIG. 5B shows in another way, where distance A and distance B thereon are not equal distances, that the skirting system 410 and the structural base 402 may not be square for a structural base 400 that an installer desires to cover with one of the systems described herein. Because the coping and skirting systems described herein include separate components, and because the coping systems described herein are outwardly spaced from the skirting systems described herein when each system is mounted to a structural base, the two systems may form different angles, but the difference is not visible from a side of the structural base. It should be noted here that in at least one embodiment a spacer (described in greater detail below) is positioned in each of the corners of the coping and skirting systems shown in FIG. 5B Again, the coping systems 400 described herein can be used by the installer to provide a square perimeter (i.e. having right-angled corners) around the field of floating tiles that are to be positioned on top of the structural base 402 which may or may not be square.

Referring to FIG. 5C, herein a structural base is shown where an installer has chosen the side of the structural base with the stairs as a datum edge for installing the systems described herein. The installer has also chosen to use a coping system according to at least one embodiment described herein to obtain a square perimeter on the side of the structural base having the distances C and D, and has chosen to build a ladder to both provide a square perimeter on the side of the structural base having the distances E and F as well as extend a width of the structural base to, for example, reduce the number of tiles that need to be cut to cover the top surface of the structural base Continuing with FIG. 5C, to position coping brackets on the structural base shown therein, an installer begins by adding a datum line to a top surface of the structural base. The datum line 430 is shown in FIG. 4D. Datum line 430 is a line that is parallel to the datum edge of the structural base selected by the installer. Typically, an installer should choose the datum line 430 to be adjacent to a front face of the structural base or a face of the structural base having a staircase, for example.

Figure 5D:
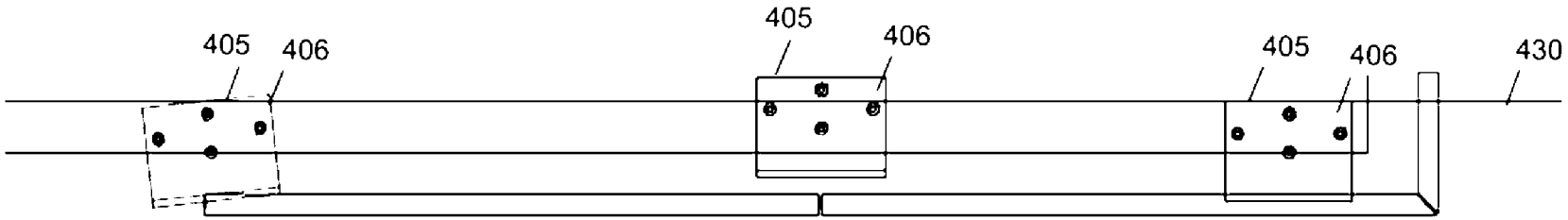
FIG. 5D is a top down view of a plurality of coping brackets according to at least one embodiment described herein misaligned along a datum line.
Figure 5E:
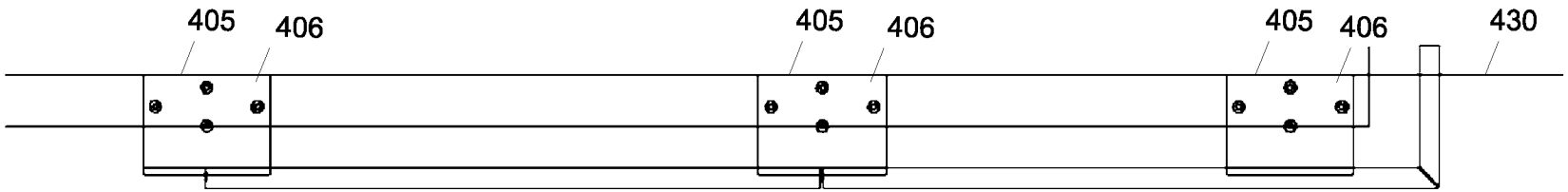
FIG. 5E is a top down view of a plurality of coping brackets according to at least one embodiment described herein properly aligned along a datum line.

FIG. 5D shows one embodiment of incorrectly installing a plurality of coping brackets 406. Here, if the rear edge 405 of the coping bracket 406 is not aligned with the datum line 430, the coping brackets 406 will not be properly positioned to provide for a coping tile mounted thereon to form a rigid perimeter for inhibiting movement of the floating field tiles. FIG. 5D shows that the coping brackets 406 may, if incorrectly installed, twist or otherwise be crooked relative to the datum line 430. Given the close tolerances between the lip of coping bracket 406 and the groove of coping tiles 404, the coping brackets 406 must be accurately aligned to each other and be perpendicular field edges. To provide for the perimeter formed by the coping brackets 406 to be square, each coping bracket 406, specifically each rear edge 405 of each coping bracket 406, needs to be aligned on the datum line 430. This is shown in FIG. 5E. When the plurality of coping brackets 406 are properly aligned along datum line 430 and mounted to the structural base 402, each coping lip 409 of each coping bracket 406 will be vertically and horizontally coplanar. Coping brackets 406 include a plurality of apertures for receiving a fastener to provide for the coping brackets 406 to be mounted to the top surface of the structural base 402 in a location that is along the datum line 430.

Figure 5F:
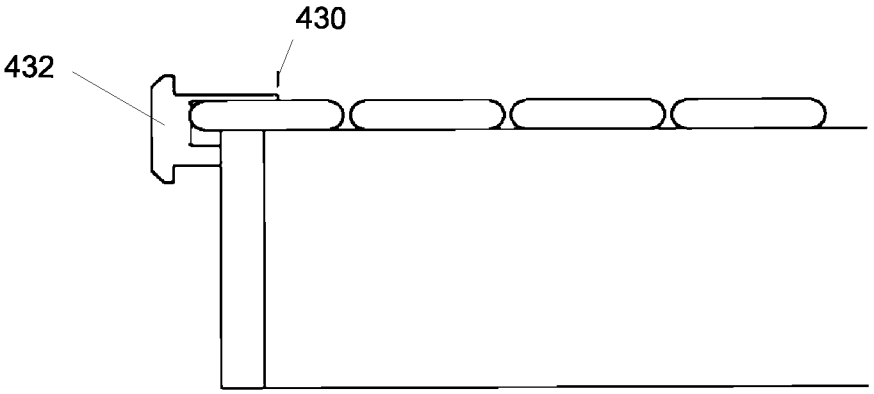
FIG. 5F is a side view of a structural base and a jig being used to mark a datum line thereon.
Figure 5G:
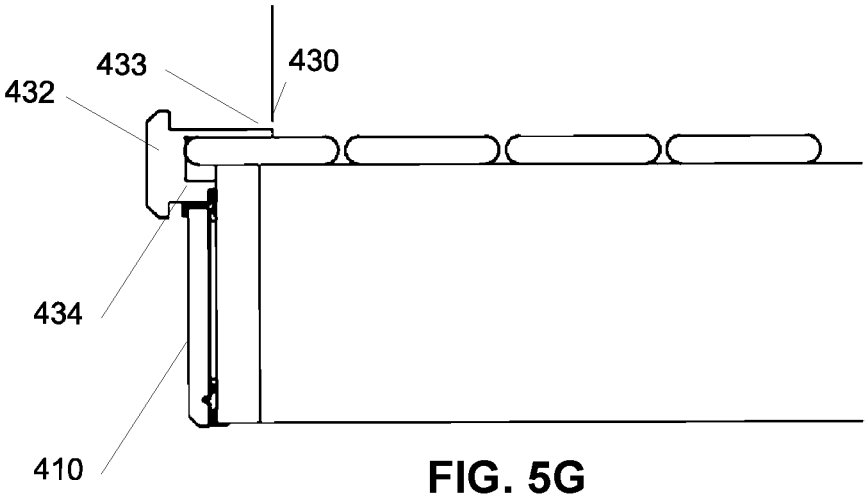
FIG. 5G is a side view of a structural base having a skirting system according to at least one embodiment described herein and a jig being used to mark a datum line thereon.
Figure 5H:
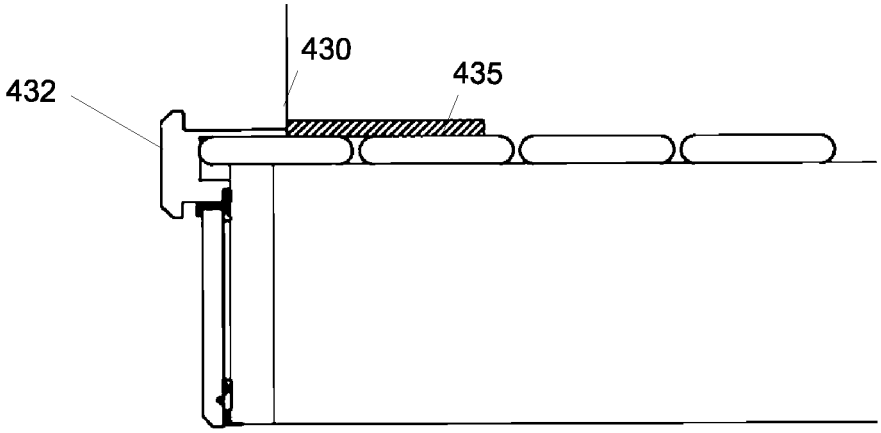
FIG. 5H is a side view of a structural base having a skirting system according to at least one embodiment described herein and a jig being used to mark a datum line thereon and an alignment tool mounted along the datum line.

FIGS. 5F to 5H show that a coping jig 432 can be used to establish the datum line 430 by placing the coping jig 432 against a rim board of the structural base and then positioning an alignment tool 434 to abut the coping jig 432 on the top surface of the structural base. Specifically, the alignment tool 434 provides the datum line 430 when the alignment tool 434 abuts an upper edge 433 of the coping jig 432 when a bottom portion 434 of coping jig 432 is pressed against the side surface (e.g. rim board) of the structural base (see FIG. 5G). FIG. 5F shows that the jig 432 can be used to establish the datum line 430 when the structural base is an existing deck with no other systems described herein mounted thereon. FIG. 5G shows that the jig 432 can be used to establish the datum line 430 when the structural base has a skirting system 410 as described herein mounted thereon. In instances where datum line 430 is being established near a corner of the structural base, the jig 432 should be used on both sides of the corner together with the alignment tool 434, as described in greater detail below.

As shown in FIG. 5H, after datum line 430 is established by jig 432 and alignment tool 434 (e.g. a piece of wood), alignment tool 434 is fastened to the top surface of the structural base to make it easy to maintain the position of the datum line 430 established by an edge 436 of a long side of the alignment tool 434.

Figure 5I:
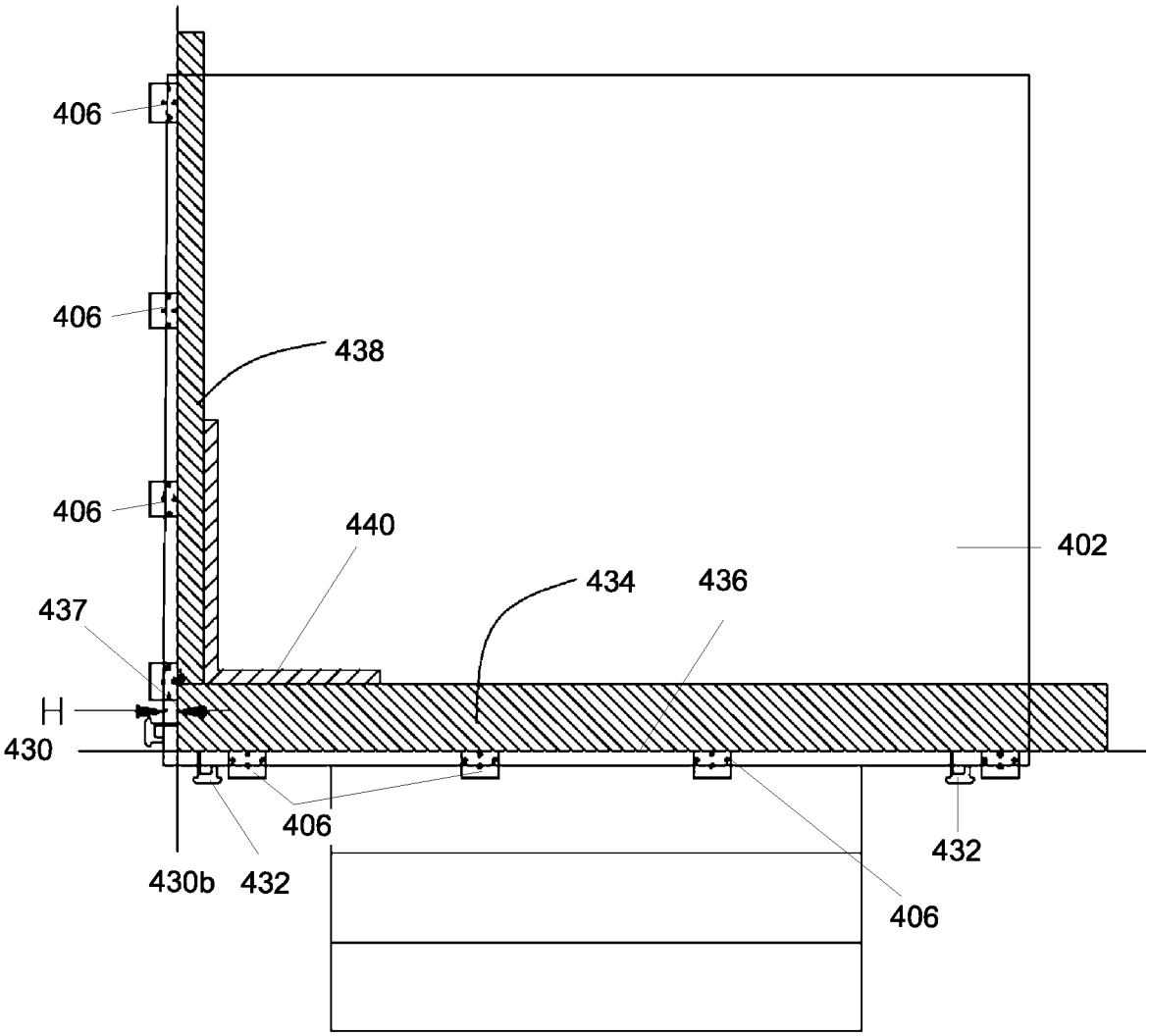
FIG. 5I is a top view of the structural base of FIG. 5H having two alignment tools mounted thereon for positioned a coping system according to at least one embodiment described herein on the structural base.

As shown in FIG. 5I, when alignment tool 434 is fastened onto the structural base 402 so a long edge 436 of the tool 434 is establishes datum line 430, a short edge 437 of alignment tool 434 is used together with alignment tool 438 to establish a second datum line 430*b* transverse to datum line 430. Short edge 437 of alignment tool 434 can be positioned using jig 432 in the same manner as described above for long edge 436. Second alignment tool 438 is then used to establish datum line 430*b* along a long edge thereof together with square 440. Square 440 is used to ensure datum line 430*b* is perpendicular to datum line 430. Distance H shown in FIG. 5I is the distance between an edge of the structural base and short edge 437 of tool 434. This distance may change along long edge of tool 438 as the datum line 430*b* is placed on the structural base.

Once the datum lines 430 and 430*b* are established, coping brackets 406 are be mounted to the structural base 402. Since the rear edge 405 of mounting portion 407 extends rearwardly from a front face of the coping bracket 406 a same distance as the upper portion 433 of the coping jig 432 extends rearwardly from a front face of the coping jig, when the rear edges 405 of the coping brackets 406 are aligned with the datum line 430 (or 430*b*), each of the coping lips 409 of the coping brackets 406 will be coplanar to each other.

Figure 6C:
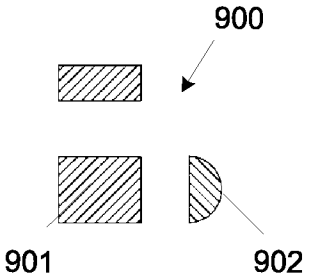
FIG. 6C shows top, side and front views of another spacer according to at least one embodiment described herein.
Figure 6B:
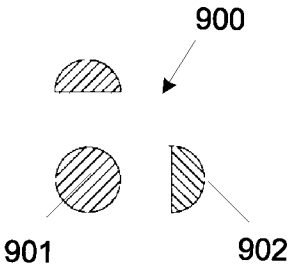
FIG. 6B shows top, side and front views of a spacer according to at least one embodiment described herein.
Figure 6A:
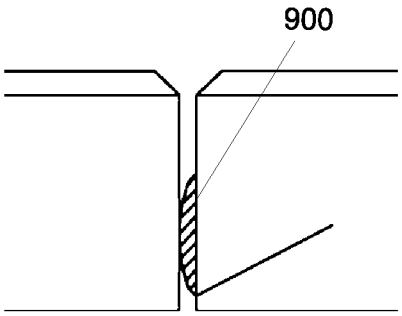
FIG. 6A is a side view of two floating field tiles with a spacer according to at least one embodiment described herein positioned therebetween.

Turning to FIG. 6, FIG. 6A shows a side view of two field tiles for use in at least one embodiment of the systems and methods described herein. FIG. 6A shows a spacer 900 creating a gap between adjacent tiles and shows that each of the tiles has a chamfer (i.e. a sloping edge) on their tope edge, in order to make the thin gaps between field tiles consistent along their length and aesthetically pleasing. In at least one embodiment, the gap has a width in a range of about 2 mm to about 3 mm. In at least one embodiment, the chamfer has a width in a range of about 2 mm to about 3 mm. Spacer 900 provides for and maintains the gap between the tiles. In at least one embodiment, spacer 900 has a height that is approximately ½ the tile height and is mounted nearer to the bottom edge of the tile than to a top edge of the tile. In at least one embodiment, the spacer is black or clear and, as a result, the spacer is not easily visible from above.

As briefly noted above with reference to FIG. 1D, tile-based decking systems described herein use solid tiles that are precisely machined and sized. Decking systems described herein also provide for rigidly maintaining gaps between adjacent tiles for drainage purposes, while simultaneously adapting to seasonal movements of the structure. As such, the floating field tile assembly is rigid to the feel (e.g. under feet) yet flexible to the environment. Further to this, the decking systems described herein should provide for the final tiles to be installed easily and rigidly yet eliminate the potential for one tile to grind against a neighboring tile. Finally, the decking systems described herein should provide for the ability to replace any tile in the deck in a reasonably simple manner.

FIGS. 6B and 6C show magnified views of two embodiments of the spacers briefly described in FIG. 6A, showing three views of each embodiment. As noted above, each spacer 900 is mounted on a side of the deck tile. The spacers 900 can be virtually any shape in the front and top views. It should be noted that the shapes shown in FIGS. 6B and 6C are only two example embodiments of spacers described herein. In the side view, the spacers 900 shown in FIGS. 6B and 6C are each are tapered form a base 901 therefore towards a peak 902. For instance, the spacer 900 of FIG. 6B may be shaped to be approximately hemispherical and the spacer 900 of FIG. 6C is shaped to be approximately hemicylindrical. Spacer 900 is shaped to minimize an area of contact between the peak 902 of the spacer 900 and the tile positioned against the peak 902. Minimizing the area of contact between the peak 902 of the spacer 900 and the tile positioned against the peak 902 reduces a tendency for the spacer 900 to creep upwards as the floating tiles shift and move vertically and/or laterally (e.g. in response to seasonal temperature changes, pedestrian traffic thereon, etc.).

Each spacer 900 is rigid yet flexible and compressible. For example, spacer 900 has a Shore B hardness in a range of about 30 to 85. The spacers 900 are impervious to seasonal temperature changes and may be made of any polymeric or similar material. The thickness of each spacer establishes the gap between neighboring tiles. In at least one embodiment, the spacers 900 described herein may act as a variable rate spring when compressed by neighboring tile faces. In at least one embodiment, the spacers 900 depress to 80% thickness readily. To accomplish this, the spacers 900 may have portions thereof that are thicker than other portions of the spacer. Again, spacers 900 may have a height that is less than about one-half of the thickness of the tiles used in the systems and methods described herein (e.g. about 1 cm).

In at least one embodiment, spacers 900 typically include an adhesive (e.g. VHB™ adhesive, an acrylic adhesive, an epoxy-based adhesive, or the like) on the flat surface of the spacer, or an adhesive may be applied to the spacer to adhere the spacer to a side of the tile. Any adhesive that is impervious (i.e. resistant) to weather conditions and temperature fluctuations of seasonal changes may be used. Further, the adhesive may be factory applied to the spacers or may be applied by a user (e.g. during installation).

Figure 6D:
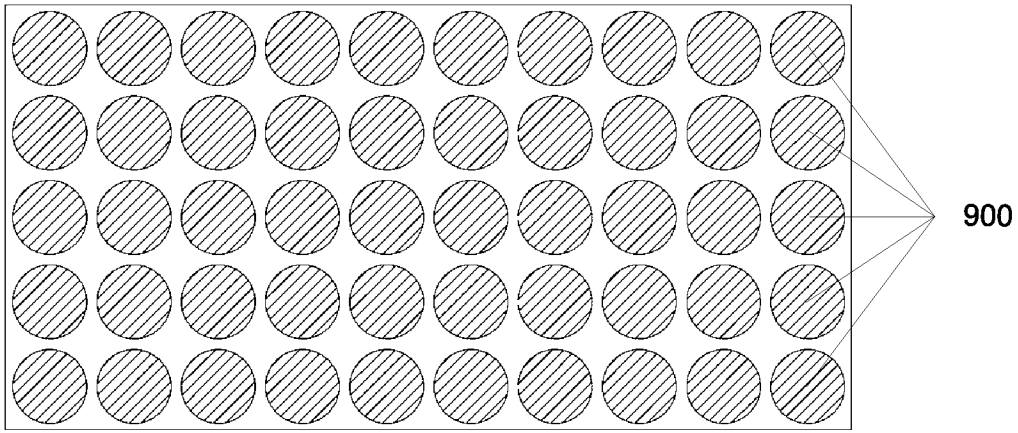
FIG. 6D is a top views of a plurality of spacers according to at least one embodiment described herein.

FIG. 6D shows one embodiment of how the spacers 900 could be packaged. Therein, a plurality of spacers 900 is shown adhered to a card making them convenient for application. In some embodiments, the spacers 900 could be applied with an applicator such as but not limited to a gun that is configured to receive a cartridge of spacers.

Figure 6E:
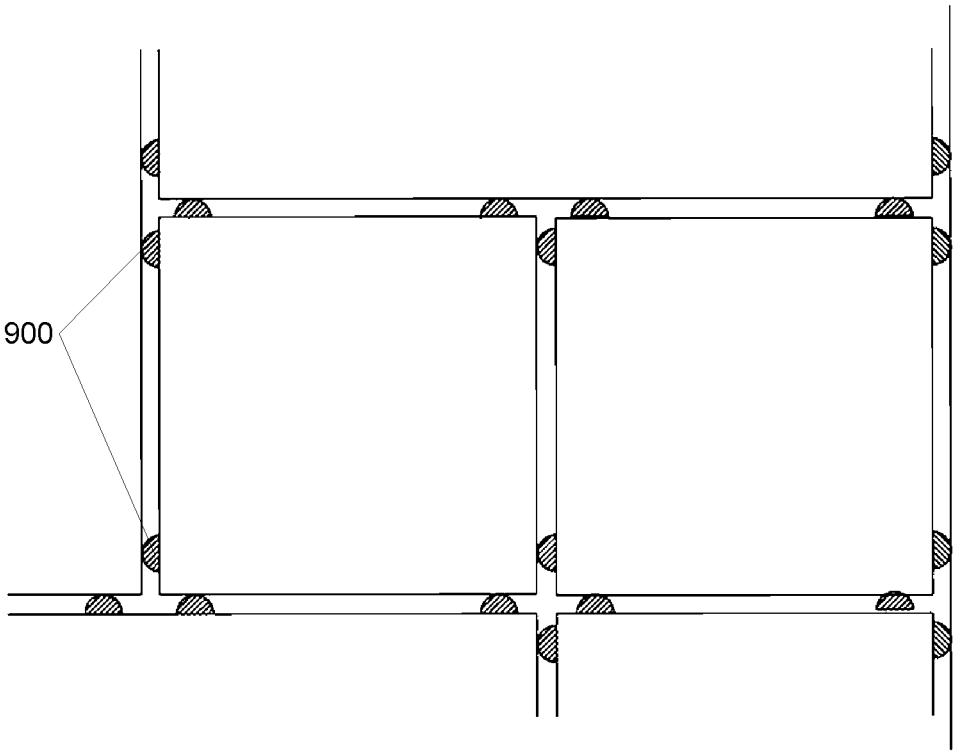
FIG. 6E is a top view of a plurality of floating field tiles with a plurality of spacers according to at least one embodiment described herein positioned therebetween.

FIG. 6E is a partial top view of a floating tile field deck system showing a plurality of spacers 900 shown as detailed in FIG. 6A and mounted to the side of floating field tiles, according to at least one embodiment. As shown therein, in at least one embodiment, each tile in a field of tiles covering the deck is spaced from an adjacent tile of the field of tiles by at least two spacers 900 (e.g. each side of each tile has at least two spacers).

Figure 7C:
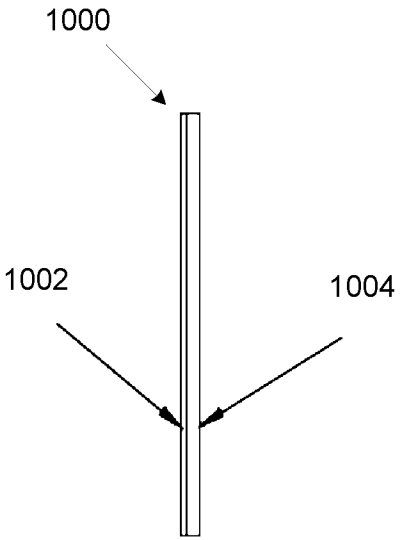
FIG. 7C is a side view of the mat of FIG. 7A.
Figure 7B:
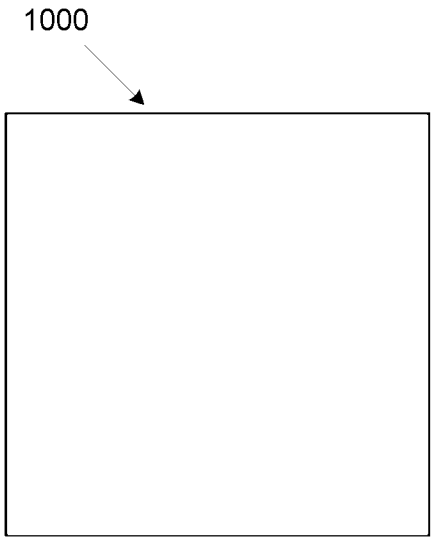
FIG. 7B is a top view of the mat of FIG. 7A.
Figure 7A:
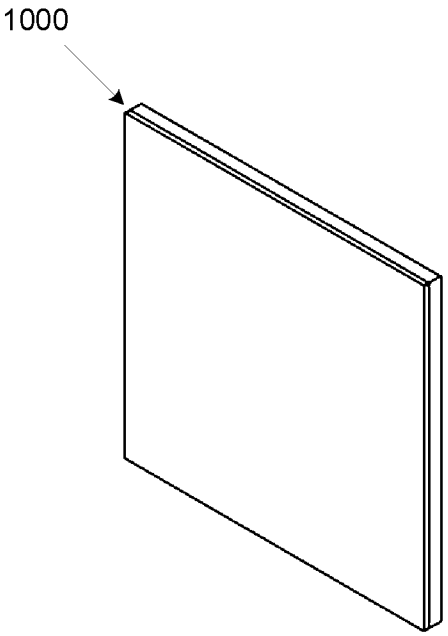
FIG. 7A is a perspective view of a mat according to at least one embodiment described herein.

Turning to FIGS. 7A to 7C, shown therein is one embodiment of a mat 1000 of the systems described herein. Mat 1000 is generally described in U.S. Provisional Patent Application No. 62/652,391 entitled "Outdoor Floor Construction", filed Apr. 4, 2018; U.S. Provisional Patent Application No. 62/779,816 entitled "Systems and Methods for Tile Floor Constructions", filed Dec. 14, 2018; and Patent Co-operation Treaty Application No. PCT/CA2019/050406 entitled "Systems and Methods for Tile Floor Constructions", filed Apr. 3, 2019, the entire contents of which are each incorporated by reference herein.

For completeness, mat 1000 includes a bedding layer 1002 and a drainage layer 1004. Generally, mat 100 is positioned underneath the field of floating tiles on a structural base to support the field of tiles and to provide for a bottom surface of the field tiles to be spaced apart from a top surface of the structural base.

Mat 1000 may be arranged as a single sheet positioned underneath all of the field tiles on a top surface of a structural base. Mat 1000 may also be arranged as a plurality of pads underneath the field tiles on a top surface of a structural base. In this arrangement, the plurality of pads are generally positioned such that there is one pad positioned under each of the corners of each floating tile of the field of floating tiles on the top surface of the structural base.

Figure 8A:
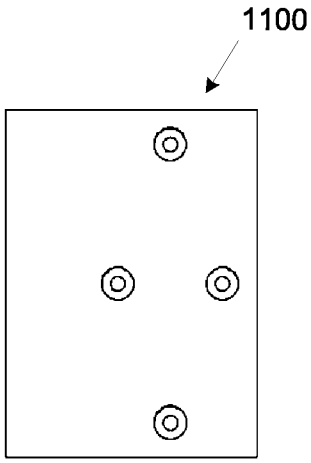
FIG. 8A is a top view of a edge tile support according to at least one embodiment described herein.
Figure 8C:
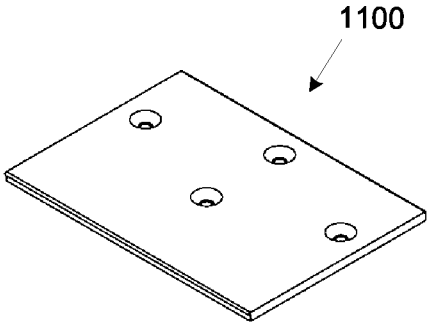
FIG. 8C is a side view of the edge tile support of FIG. 8A.
Figure 8B:
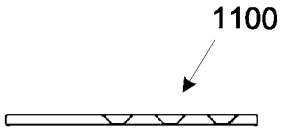
FIG. 8B is a perspective view of the edge tile support of FIG. 8A.

FIGS. 8A to 8C show an edge tile support 1100 according to at least one embodiment described herein.

Edge tile support 1100 is generally a thin plate having a thickness similar or the same as mounting portion 407 of coping bracket 406. Edge tile support 1100 may be positioned between adjacent coping brackets 406 around a perimeter of the structural base to vertically support edges of floating tiles adjacent to the coping tiles. Edge tile support 1100 is generally made of the same material as the coping bracket 406, such as but not limited to a metal.

Figure 9A:
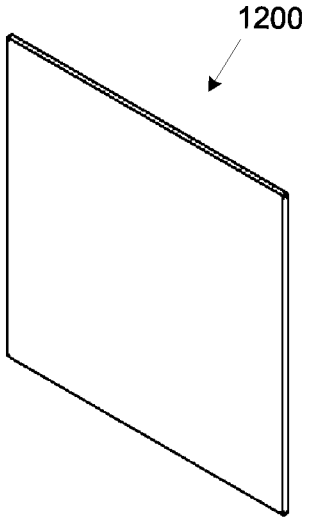
FIG. 9A is a perspective view of a bedding pad according to at least one embodiment described herein.
Figure 9B:
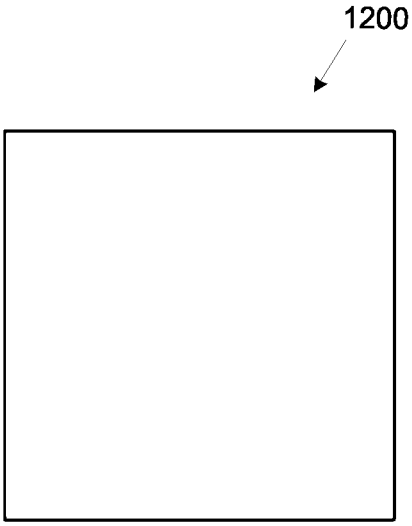
FIG. 9B is a top view of the bedding pad of FIG. 9A.
Figure 9C:
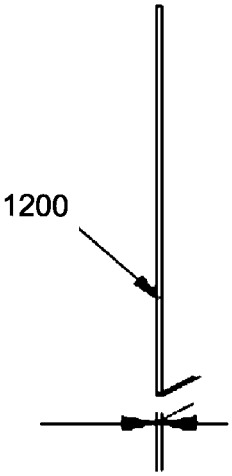
FIG. 9C is a side view of the bedding pad of FIG. 9A.

FIGS. 9A to 9C, show a bedding pad 1200 according to at least one embodiment described herein. Bedding pad 1200 is generally a small pad (e.g. 2 inches square) made of the same or similar (e.g. having similar physical characteristics, such as but not limited to a similar compressibility) material as the bedding layer 1002 of the mat 1000 and have a same thickness as the bedding layer 1002 of mat 1000. Bedding pad 1200 may be positioned on top of any edge tile supports 1100 positioned between adjacent coping brackets 406 around a perimeter of the structural base to vertically support edges of floating ties of the field of tiles and provide the floating tiles with the ability to move vertically slightly (within a compressibility tolerance of the bedding pad 1200).

Figure 10A:
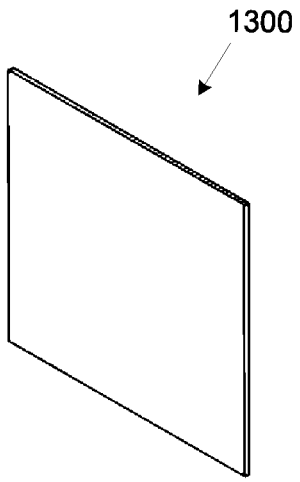
FIG. 10A is a perspective view of a shim according to at least one embodiment described herein.
Figure 10B:
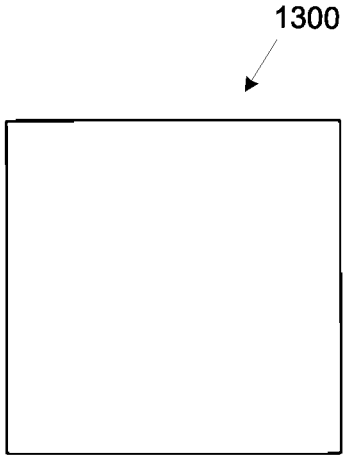
FIG. 10B is a top view of the shim of FIG. 10A.
Figure 10C:
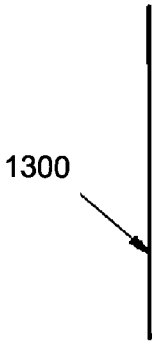
FIG. 10C is a side view of the shim of FIG. 10A.

FIGS. 10A to 10C, show a shim 1300 according to at least one embodiment described herein. Shim 1300 may be positioned underneath of the tiles within the field of floating tiles positioned on the top surface of the structural base. For instance, shim 1300 may be positioned between a bottom surface of a floating tile and a top surface of a mat 1000 thereunder. Additionally, shim 1300 may be positioned between a top surface the structural base and a bottom surface of a mat 1000 positioned thereon. Shim 1300 may be used to level out any unevenness in the tiles positioned on the structural base. It should be understood that one or more shims may be used in the systems described herein to level out any unevenness in the tiles on the structural base during final assembly. Shim 1300 has a thickness of about 1 mm.

Figure 11A:
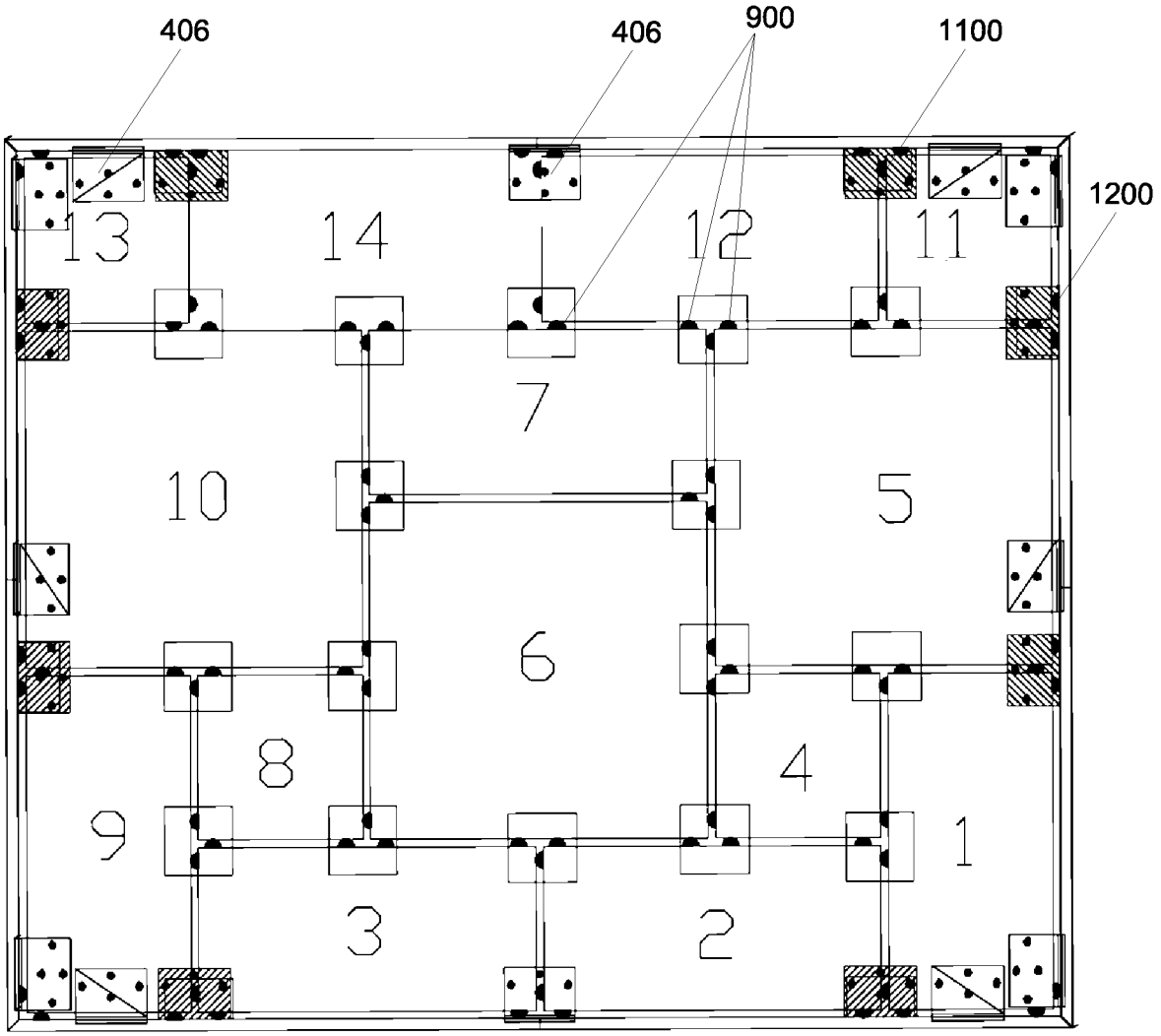
FIG. 11A is a top view of a structural base having a coping system according to at least one embodiment described herein showing an order of installing a plurality of floating field tiles positioned thereon.

FIG. 11A shows one embodiment of an order of installing tiles in a field of tiles. Mats are used under the corners to support adjacent tiles and spacers are installed at all corners. Specifically, tile 1 labeled therein receives spacers 900 on four sides of the tile. It should be noted that spacers 900 are positioned on the sides of each tile nearer to the bottom face of the tile and have a height that is approximately one-half the thickness of each tile (see also FIG. 2L, below). It should also be noted that tiles 2, 3 and 5 in the embodiment shown have three sides that receive spacers 900 and tiles 4,6,7 and 8 have two sides that receive spacers 900 (by following this procedure an installer can build out along a diagonal line). Finally, it should be noted that tile 9 only has one side that receives spacers 900 (the open side).

FIG. 11A shows one embodiment of a system described herein including showing the positioning of coping edge supports 1100, bedding pads 1200, coping brackets 406 and spacers 900.

For installing the final tile 14, as numbered above, only one edge of tile 14 receives two spacers 900. The required spacers 900 on the remaining three sides are connected to the neighboring tiles (or coping edge or other termination line as the case may be) that are already installed on the structure. In this system it is easy to install a final tile with no spacers when the required spacers (e.g. all four sides) are in place on the installed field tile assembly.

Figure 11B:
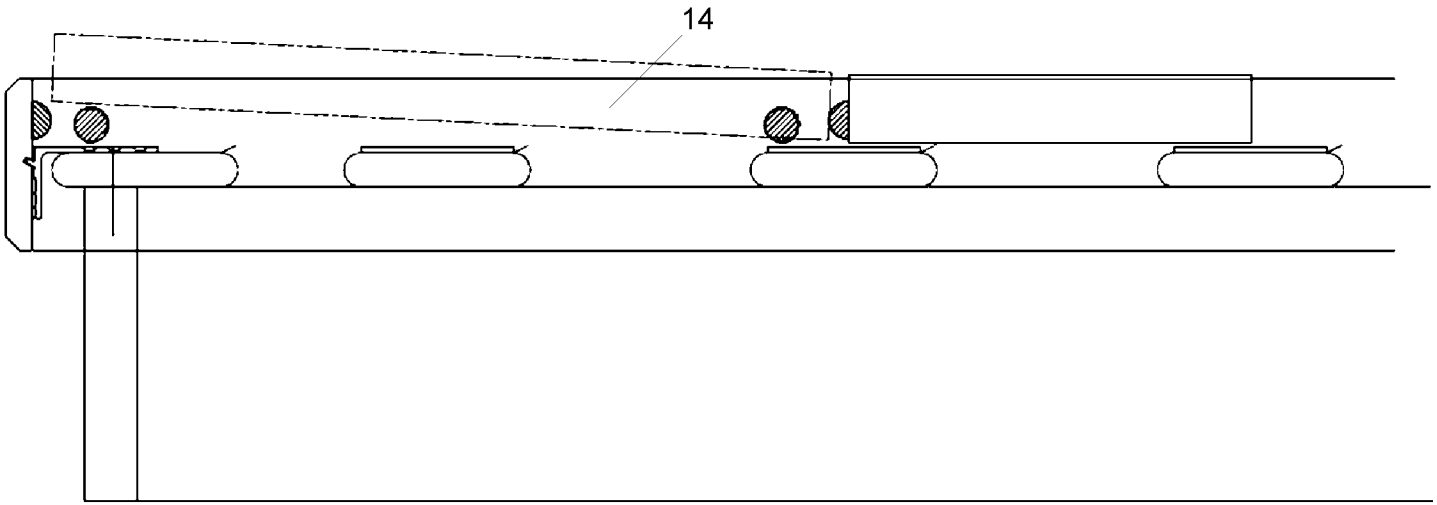
FIG. 11B is a side view of the structural base of FIG. 11A showing installation of a final floating field tile.

FIG. 11B shows how a final tile 14 is installed in a final receiving space. As shown, the top of the final receiving space is approximately 4 mm (two gaps) wider than the tile and therefore it is easy to start the install. Given that the spacers are already present on the neighboring tiles and given their shape, they direct the final tile to the center of the final receiving space as it is being installed.

Figure 11C:
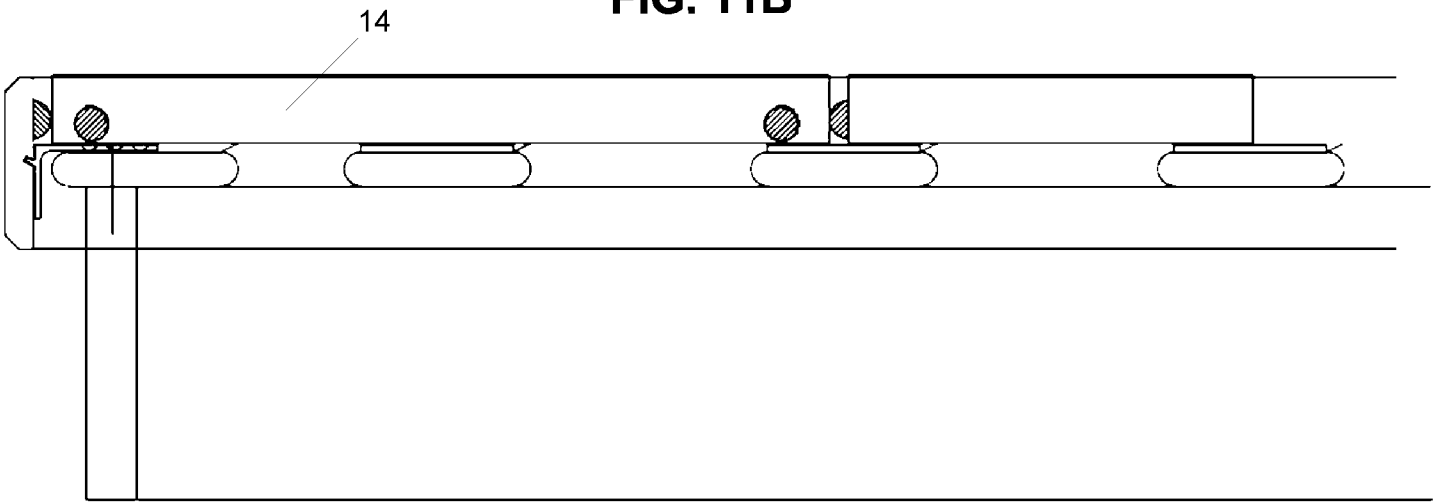
FIG. 11C is a side view of the structural base of FIG. 11A showing the final floating field tile installed.

FIG. 11C shows how tile 10 fits into a field of tiles as a final tile on an edge of the field. As tile 10 in placed into position, the installer will feel a distinct final fit/solidness as the tile is pushed down into its final resting position. The spacers 900 surrounding the tile provide for small gaps (e.g. about 2 mm) around the tile that, for example, provide for drainage of water off from the surface of the tiles. These gaps also provide for seasonal warping of the structural base without grinding and/or provide for movement of the tiles caused by pedestrian traffic without grinding.

Figure 12A:
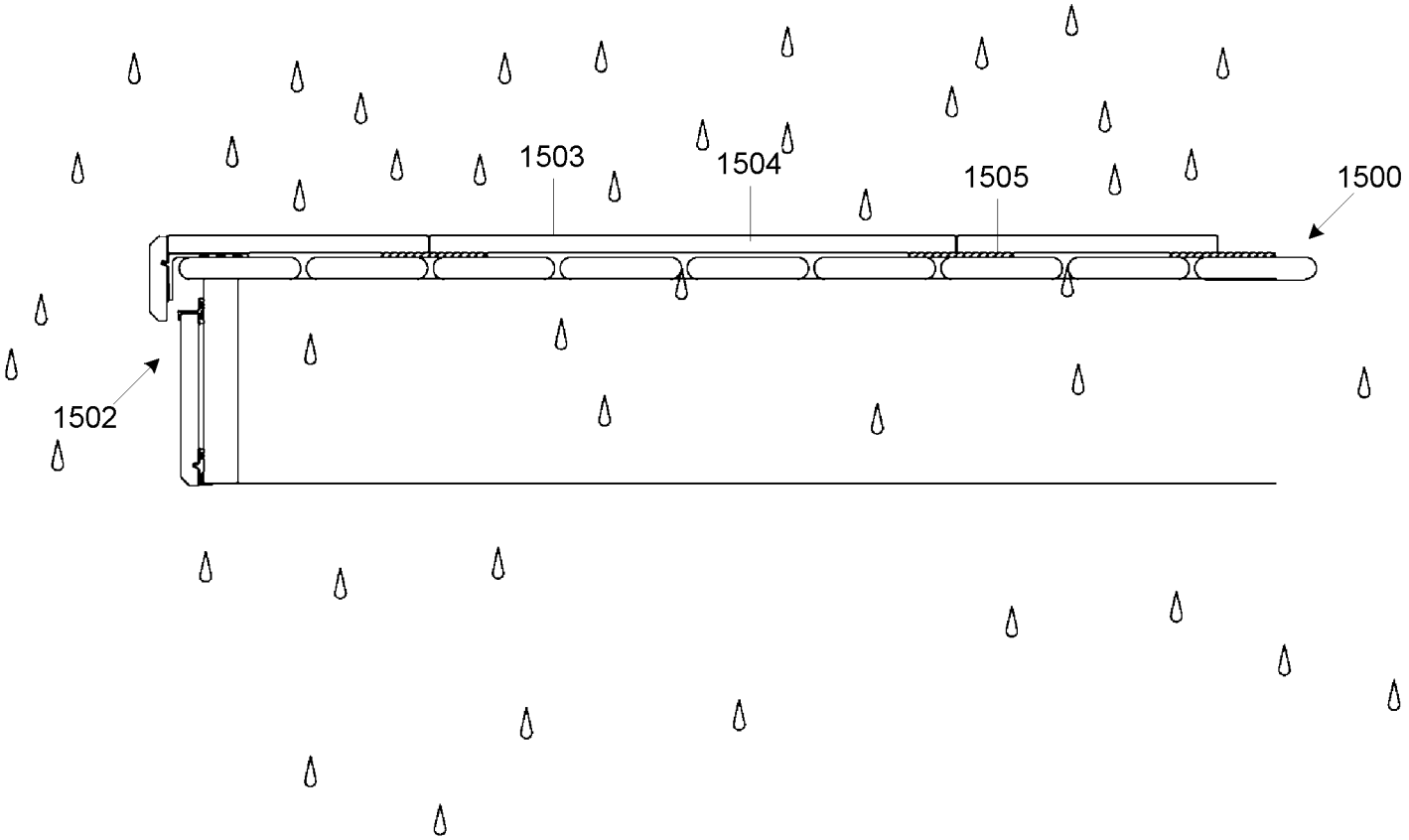
FIG. 12A is a side view of a system for covering a structural base according to at least one embodiment described herein having water pass therethrough.
Figure 12B:
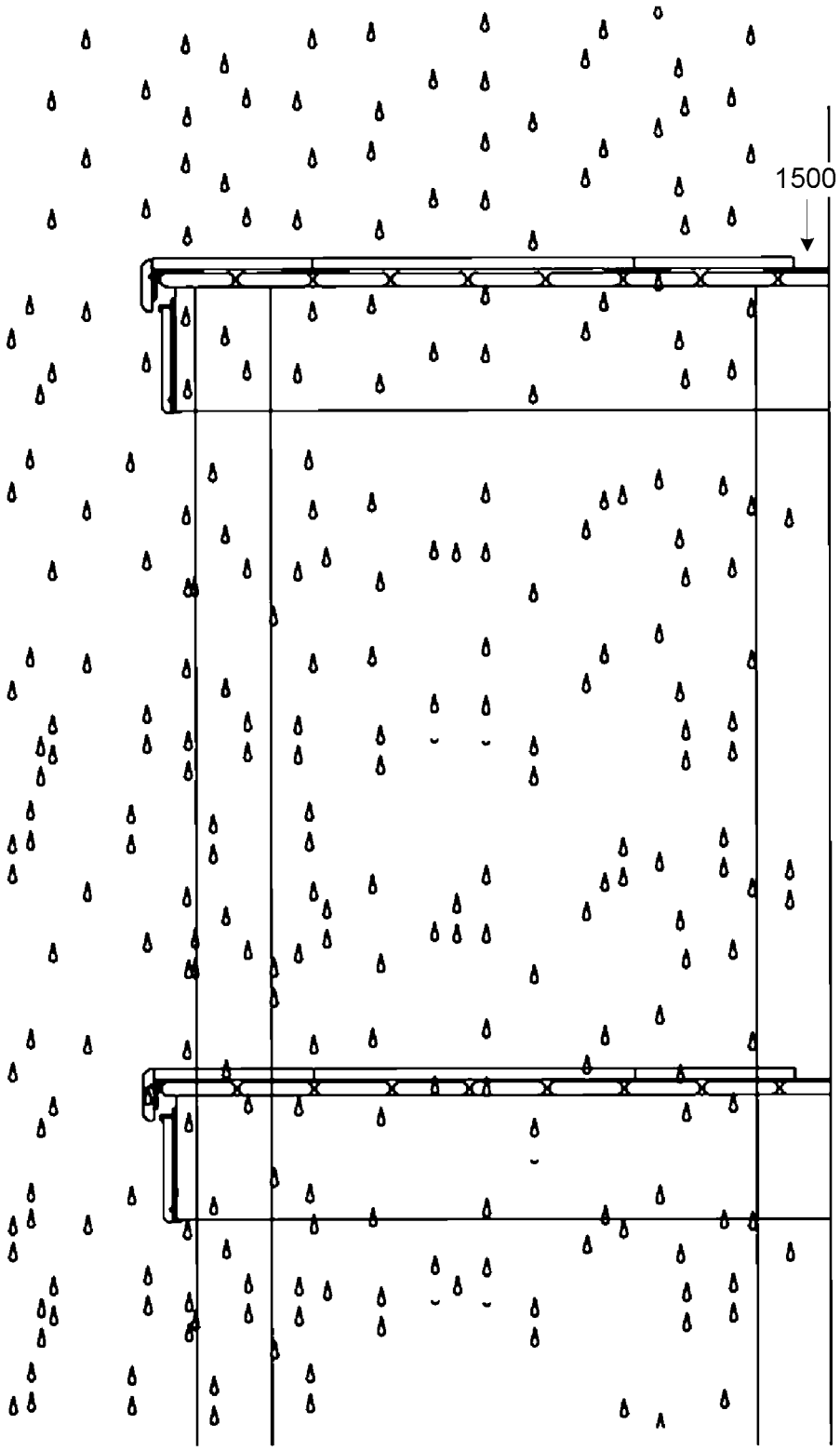
FIG. 12B is a side view of the system of FIG. 12A positioned above another structural base and water passing through the system of FIG. 12A onto the other structural base.
Figure 12C:
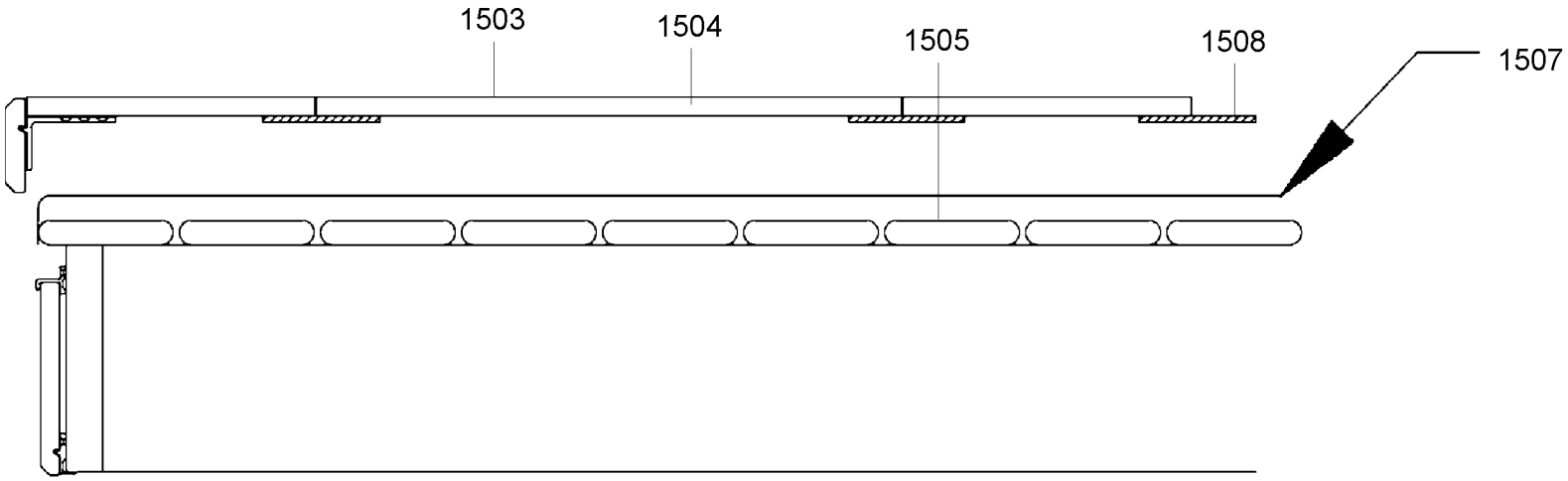
FIG. 12C is a side view of a system for covering a structural base including a waterproof membrane according to at least one embodiment described herein.
Figure 12D:
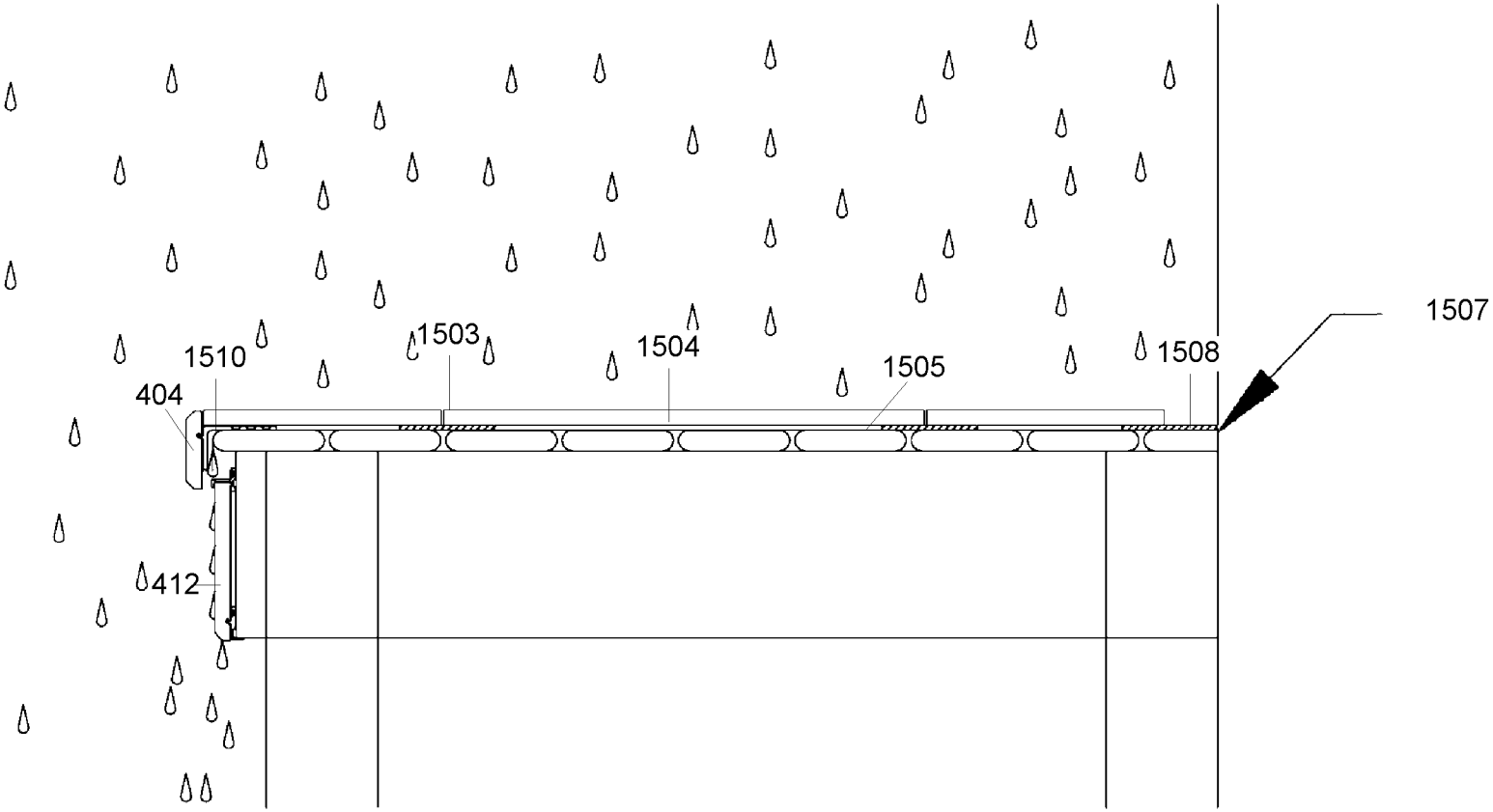
FIG. 12D is a side view of the system of FIG. 12C on a structural a base showing water being collected by the waterproof membrane and directed over an edge of the structural base.
Figure 12E:
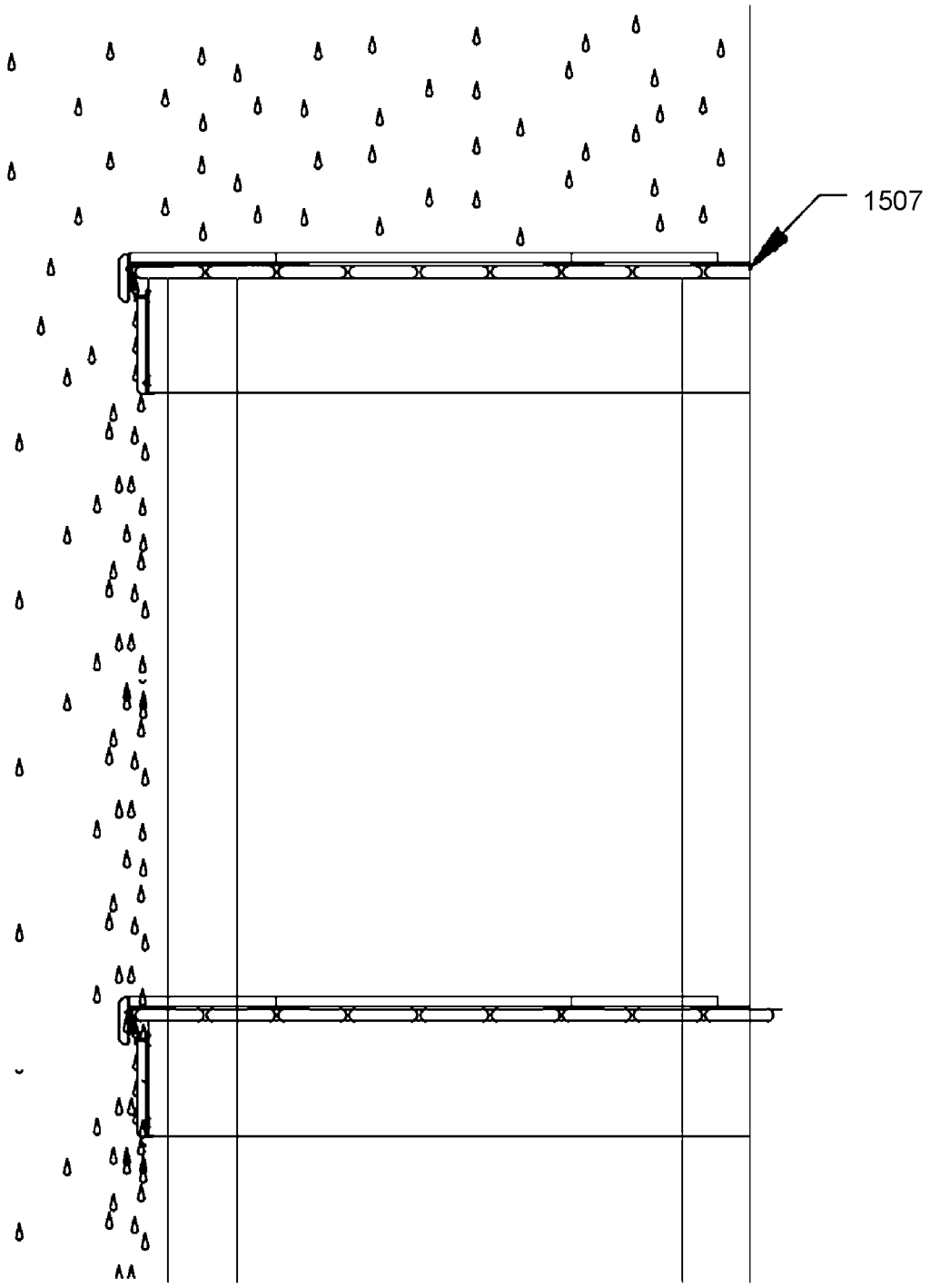
FIG. 12E is a side view of the system of FIG. 12D on a structural a base positioned above another structural base and water not passing through the system of FIG. 12D onto the other structural base.

FIGS. 12A to 12E show another component of the systems described herein. Specifically, FIGS. 12C and 12D show a waterproof membrane 1507 positioned within the systems described herein.

FIG. 12A shows a structural base 1500 having a system 1502 for covering the structural base thereon, as described in one or more embodiments herein. As shown therein and described above, the system 1502 is configured to provide for water to pass from a top surface 1503 of the field of floating tiles 1504 downwardly between the tiles to a top surface 1505 of the structural base 1500. In embodiments where the structural base 1502 is a deck, such as but not limited to a pressure-treated deck, the water can continue downward through the top surface 1505. This is desired in many situations. This may be undesirable in situations such as that shown in FIG. 12B, where a second structural base (e.g. a deck, patio or the like) is positioned below the structural base 1500. In this example, it may be desirous to collect the water passing from top surface 1503 of the field of floating tiles 1504 downwardly between the tiles to a top surface 1505 of the structural base 1502 to inhibit the water from continuing to fall towards the second structural base below.

FIG. 12C shows system 1502 including a waterproof membrane 1507. Waterproof membrane 1507 is configured to collect the water passing from top surface 1503 of the field of floating tiles 1504 downwardly between the tiles to a top surface 1505 of the structural base 1502. In the embodiment shown in FIG. 12C, waterproof membrane 1507 is positioned between a bottom surface of mat 1508 and the tops surface 1505 of the structural base 1502. It should be understood that the waterproof membrane 1507 may also be positioned between a top surface of the mat 1508 and bottom surface of the tiles 1504.

By collecting the water and redirecting it over an edge 1510 of the structural base 1502, such as is shown in FIG. 12D, membrane 1507 inhibits water from passing through the structural base 1500 (see FIG. 12E) onto the deck or patio below. In at least one embodiment, membrane 1507 collects the water and redirects it over the edge 1510 behind coping tiles 404. In at least one embodiment, membrane 1507 collects the water and redirects it over the edge 1510 in front of skirting tiles 412. In at least one embodiment, membrane 1507 collects the water and redirects it over the edge 1510 through a gap behind the coping tiles 404 and in front of skirting tiles 412.

While the applicant's teachings described herein are in conjunction with various embodiments for illustrative purposes, it is not intended that the applicant's teachings be limited to such embodiments as the embodiments described herein are intended to be examples. On the contrary, the applicant's teachings described and illustrated herein encompass various alternatives, modifications, and equivalents, without departing from the embodiments described herein, the general scope of which is defined in the appended claims.

What is claimed is:

1. A system for covering a structural base, the system comprising:

a plurality of floating field tiles arranged to cover a top surface of the structural base;

a mat positioned between a bottom surface of at least one of the floating field tiles and a top surface of the structural base to separate the bottom surface of the floating field tile from the top surface of the structural base; and a coping system secured to the top surface of the structural base, the coping system including:

a plurality of coping brackets secured to the top surface of the structural base, each of the plurality of coping brackets having a coping lip extending upwardly and away from a front surface of the structural base; and a plurality of coping tiles hanging on the plurality of coping brackets such that an upper edge of each of the coping tiles is positioned to be above a bottom edge of the field tiles to form a fixed perimeter around the plurality of floating field tiles to inhibit lateral movement of the plurality of floating field tiles.

2. The system of claim 1, wherein each of the coping brackets is configured to support one or more of the coping tiles so that each of the coping tiles is positioned in front of and spaced apart from a side surface of the structural base.

3. The system of claim 1, wherein each of the coping brackets further includes:

a mounting portion extending rearwardly over the top surface of the structural base and configured to be secured to the top surface of the structural base, the mounting portion having a mounting edge to determine a position for mounting the coping bracket; and a downward hanging depending portion coupled to the mounting portion, the depending portion being a face on which to apply a flexible adhesive.

4. The system of claim 3, wherein when the mounting edge of the mounting portion of each coping bracket is aligned along a datum line established using a coping jig, the coping lip of each coping bracket is coplanar with each other coping lip of each other coping bracket.

5. The system of claim 3 further comprising:

a plurality of edge tile supports positioned around the perimeter and underneath the floating field tiles; and a plurality of bedding pads, each bedding pad positioned on top of one of the plurality of edge supports to support the floating field tiles at an edge of the structural base;

wherein a thickness of the edge tile support plus a thickness of the bedding pad is the same as a thickness of the mat.

6. The system of claim 3, further comprising:

a plurality of bedding pads, each bedding pad being positioned on the mounting portion of one of the coping brackets to support the floating field tiles at an edge of the structural base;

wherein a thickness of the mounting portion plus a thickness of the bedding pad is the same as a thickness of the mat.

7. The system of claim 3, wherein the coping lip is positioned on the downward hanging depending portion to provide for the upper edge of the one or more coping tiles hanging thereon to be level with or below the top surface of the floating field tiles.

8. The system of claim 1, wherein each coping tiles has a groove in a rear side thereof, each groove being sized and shaped to match a size and a shape of the coping lip for each coping tile to hang on a respective coping lip.

9. The system of claim 1 further comprising a skirting system, the skirting system having:

a plurality of skirting brackets secured to the structural base;

a plurality of skirting clips secured to the structural base; and a plurality of skirting tiles mounted on skirting lips of the plurality of skirting brackets and retained in front of a side surface of the structural base by the plurality of skirting clips.

10. The system of claim 9, wherein the skirting system is mounted to a side surface of the structural base and the coping system is mounted to the top surface of the structural base and is independent of the skirting system.

11. The system of claim 9, wherein the skirting bracket is configured to be mounted to a side surface of the structural base when a portion of the skirting bracket is against a bottom surface of a rim joist of the structural base.

12. The system of claim 9, wherein the coping brackets are mounted to the top surface of the structural base at a position to provide for a gap between a rear surface of the coping tiles and a front surface of the skirting tiles.

13. The system of claim 9, further comprising a plurality of spacers positioned between adjacent coping tiles of the plurality of coping tiles and between adjacent skirting tiles of the plurality of skirting tiles.

14. The system of claim 1, further comprising a plurality of spacers positioned between adjacent floating field tiles of the plurality of floating field tiles, the spacers being configured to space the adjacent tiles apart from each other and maintain a consistent gap between the adjacent floating field tiles and restrain lateral movement of the floating field tiles.

15. The system of claim 14, wherein at least two spacers are positioned between each pair of adjacent floating field tiles of the plurality of floating field tiles.

16. The system of claim 15, wherein:

each of the plurality of spacers has a height that is less than about one half of a thickness of each of the floating field tiles; and each of the plurality of spacers is positioned nearer to a bottom surface of the floating field tiles than to a top surface of the floating field tiles to hide the spacers from view of a person on the top surface of the floating field tiles.

17. The system of claim 16, wherein each of the plurality of spacers is shaped to taper from a base of the spacer towards a tip of the spacer.

18. The system of claim 1 further comprising a waterproof membrane positioned between a bottom surface of the mat and the top surface of the structural base.

19. The system of claim 18, wherein the waterproof membrane covers the top surface of the structural base to collect water falling from a top surface of the plurality of floating field tiles and overhangs an edge of the structural base to direct the water over the edge of the structural base and behind the plurality of coping tiles.

* * * * *